US005159390A

United States Patent [19]

Imaizumi

[11] Patent Number: 5,159,390

[45] Date of Patent: Oct. 27, 1992

[54] IMAGE FORMING APPARATUS CAPABLE OF FORMING IMAGES OF TWO SEPARATE DOCUMENTS ON TWO SEPARATE COPY SHEETS WITH A SINGLE EXPOSURE

[75] Inventor: Shoji Imaizumi, ShinShiro, Japan

[73] Assignee: Minolta Camera Kabushiki Kaisha, Osaka, Japan

[21] Appl. No.: 749,717

[22] Filed: Aug. 26, 1991

[30] Foreign Application Priority Data

Aug. 27, 1990 [JP] Japan ..... 2-225864

[51] Int. Cl.[5] ..... G03G 15/16

[52] U.S. Cl. ..... 355/212; 355/271; 355/318

[58] Field of Search ..... 355/271, 274, 277, 279, 355/326, 327, 55, 57, 66, 318, 319, 320, 210, 211, 212, 252

[56] References Cited

U.S. PATENT DOCUMENTS

| | | | |
|---|---|---|---|
| 3,914,043 | 10/1975 | McVeigh . | |
| 4,362,378 | 12/1982 | Erskine et al. | 355/274 |
| 4,431,301 | 2/1984 | Hashimoto et al. | 355/274 |
| 4,515,460 | 5/1985 | Knechtel | 355/327 |
| 4,699,496 | 10/1987 | John et al. | 355/277 |
| 4,702,589 | 10/1987 | Ito | 355/24 X |
| 4,862,216 | 8/1989 | Higashi et al. | 355/218 |
| 4,984,026 | 1/1991 | Nishise et al. | 355/277 |
| 5,043,761 | 8/1991 | Johnson | 355/277 XR |

FOREIGN PATENT DOCUMENTS 60-93463 5/1985 Japan .

*Primary Examiner*—A. T. Grimley
*Assistant Examiner*—T. A. Dang
*Attorney, Agent, or Firm*—Burns, Doane, Swecker & Mathis

[57] ABSTRACT

Image forming apparatus capable of forming images of two separate documents on two separate copy sheets with a single exposure. Two separate documents, for example, facing pages of a book-type document are set on a document glass and receive a single exposure operation in order to make two images, namely, a first image corresponding to one page and a second image corresponding to another page on a transfer belt. Two sheets are sequentially fed to a transfer section. The two images on the transfer belt are sequentially transferred to the two separate sheets respectively at the transfer section.

22 Claims, 18 Drawing Sheets

IMAGE FORMING APPARATUS CAPABLE OF FORMING IMAGES OF TWO SEPARATE DOCUMENTS ON TWO SEPARATE COPY SHEETS WITH A SINGLE EXPOSURE

BACKGROUND OF THE INVENTION

1. Field of the Invention

This invention generally relates to an image forming apparatus such as a copying machine or the like and, more particularly to a controlling technique of the transfer timing of a batch of documents bound in the style of a book.

2. Description of Related Art

Various kinds of copying modes are made possible in recent copying machines, for example, a one-face copy, a double-face copy, a synthesizing copy, a dividing copy and the like modes. The dividing copy mode referred to above is to copy the spread space of a book stretching from one page over a next page, that is, supposing that the book consists of eight pages, the spread space means the fourth and fifth pages, to one or both surfaces of a copying paper after dividing the spread space in half. The dividing copy mode has been carried out in a conventional copying machine by scanning two times. In other words, every time each half of the spread space is scanned, the image is transferred to the copying paper, thereby obtaining a divided image for every half page.

Meanwhile, for copying a book-type document, the document should be pressed onto a document glass during scanning so as to prevent distortion of the image in the periphery of the binding margin. Therefore, in the case of the above-described dividing copy mode requiring two-times scanning, since the scanning time is approximately two times as long as the general case, the pressing time is correspondingly increased, giving a great deal of burden to an operator.

Particularly, when a man of short stature tries the dividing copy mode, to continue pressing the book-type document cannot be realized without an effort, otherwise the book-type document would be shifted, resulting in a loss or breakage of the image. In such case, copying should be repeated again, thereby wasting a lot of time and copying papers.

SUMMARY OF THE INVENTION

An object of this invention is to provide an image forming apparatus adapted to shorten the scanning time in the dividing copy mode, thus enabling easy copying.

Another object of this invention is to provide an image forming apparatus adapted to shorten the copying time by restricting the disturbance of an image such as a loss of the image, etc.

The image forming apparatus of this invention is provided with holding means for holding an image, setting means for setting a plurality of image sections by dividing the image held by the holding means, transfer means for transferring the image of each image section to a transfer object and control means for controlling the transfer timing. By way of example, when a book-type document is to be copied by the image forming apparatus of this invention, images of both pages of the spread space are formed on the holding means (transfer belt) and the formed images are divided into image sections for each page, and the transfer timing of the image from the transfer belt to a copying paper is controlled in accordance with the respective image sections. At this time, the conveying timing of the copying paper to the transfer belt is also controlled to be synchronism with the transfer timing of the images. Accordingly, one time exposing and scanning is enough to expose and scan the book-type document, thereby reducing the scanning time.

The above and further objects and features of the invention will more fully be apparent from the following detailed description with accompanying drawings.

DESCRIPTION OF THE PREFERRED EMBODIMENTS

This invention will be discussed in detail taken in conjunction with preferred embodiments thereof with referring to the accompanying drawings.

Figure 1:
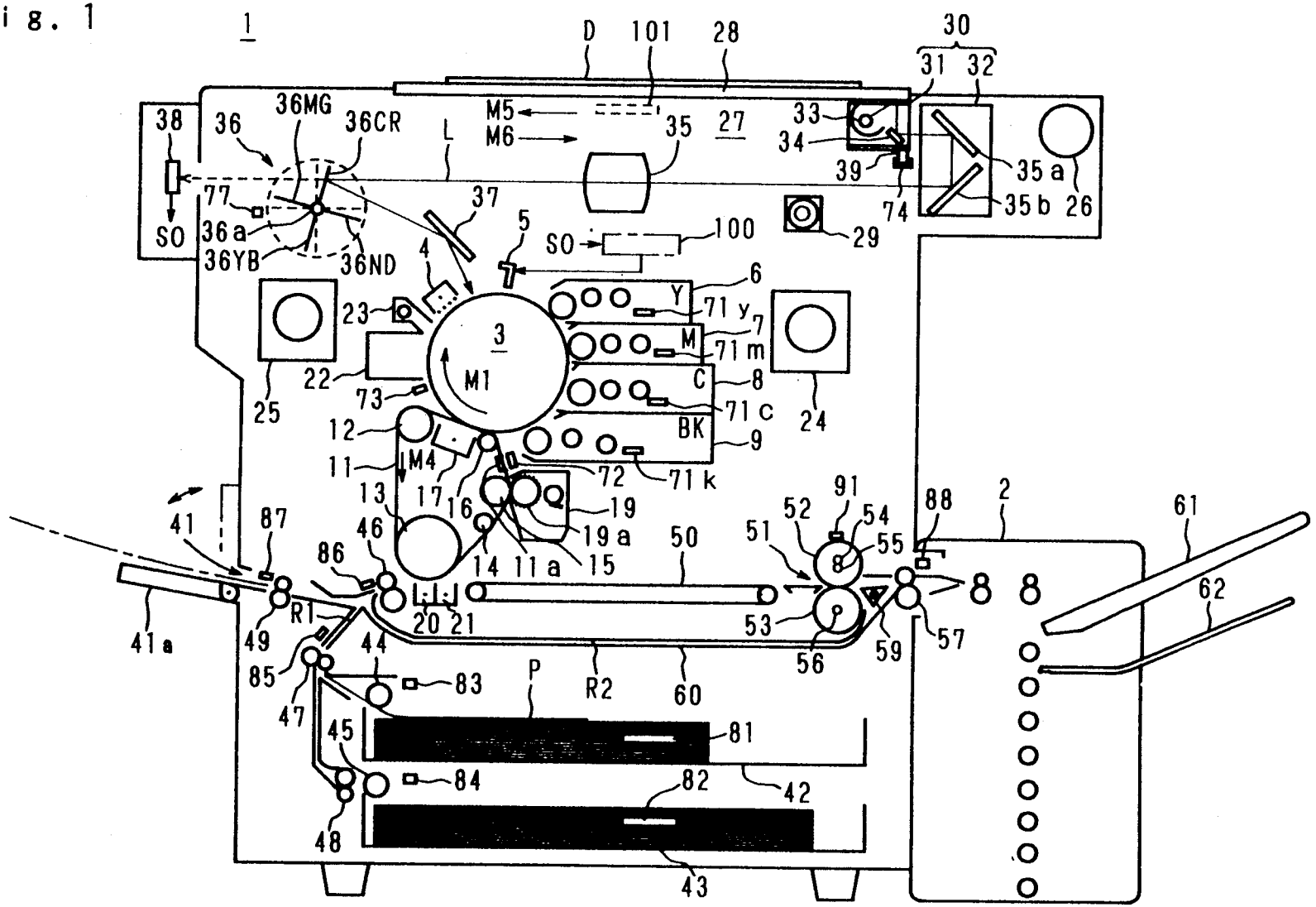
FIG. 1 is a longitudinal cross sectional view showing the structure of an analog full-color copying machine embodied by this invention.

Referring to FIG. 1 showing an analog full-color copying machine 1 according to one embodiment of the present invention, a photosensitive drum 3 is provided relatively upper leftward of the center of the copying machine 1 to be rotatable in a clockwise direction (direction of an arrow M1). An electrostatic charger 4, an editing eraser 5, developers 6–9 , a transfer belt 11, a cleaning device 22 and a main eraser 23 are mounted in the periphery of the photosensitive drum 3.

A photosensitive layer is formed on the surface of the photosensitive drum 3. When the photosensitive drum 3 passes the main eraser 23 and electrostatic charger 4, the surface of the drum is uniformly charged and exposed to form a latent image by an optical system 27 including an optical scanning device. The editing eraser 5 is utilized for forming a full-color image, and comprised of an LED array having many LEDs aligned in a holder provided along an axial direction of the photosensitive drum 3. The editing eraser 5 is capable of partly deleting the latent image on the photosensitive drum 3. The developers 6–9 contain developing materials of respective mixture of toners, namely, yellow (Y), mazenta (M), cyan (C), black (CK) and carriers. The concentration of each toner is controlled by a toner concentration sensor 71*y*, 71*m*, 71*c* or 71*k*. It is to be noted that the developers 6–9 are not necessarily fixedly mounted on the periphery of the photosensitive drum 3, but may be formed integrally into one body to be movable in an up-and-down direction. That is, it is enough that toners of different colors can be selectively supplied to the photosensitive drum 3.

The transfer belt 11 temporarily holds a toner image developed onto the photosensitive drum 3 by the developers 6–9 before the toner image is transferred to a paper P (secondary transfer). The transfer belt 11 in hung around a plurality of rollers 12–16 and kept always in contact with the photosensitive drum 3. Moreover, the transfer belt 11 is rotatable in a counterclockwise direction (direction of an arrow M4). A transfer charger 17 is disposed inside the transfer belt 11 to transfer the toner image from the photosensitive drum 3 onto the transfer belt 11 (primary transfer). Outside the transfer belt 11, there are provided a transfer charger 20 for the secondary transfer, a separation charger 21 for separating the paper P from the transfer belt 11 and a belt cleaner 19 having a fur brush 19*a* to clean the outer surface of the transfer belt 11. The fur brush 19*a* is selectively brought in pressed contact with (at the cleaning time) and detached from the transfer belt 11. The angular position of the transfer belt 11 during rotation is known by a belt mark 11*a*. Between rollers 15 and 16, a mark sensor 72 for detecting the angular position of the transfer belt 11 during rotation is fixedly mounted.

A document glass 28 is placed on the upper surface of the copying machine 1. A document size detecting device 101 which is built in at the inner side of the copying machine 1 immediately below the document glass 28 moves in a manner not in hinder scanning to detect the size of a document D. The optical system 27 in the upper part of the copying machine 1 is constituted by a scanner 30 which is reciprocable in directions of an arrow M5 (forwarding direction) and an arrow M6 (returning direction) below the document glass 28, a main lens whose position is adjusted in correspondence to the copying magnification, a filter selecting device 36 for the color separation exposure, a fixed mirror 37 which guides a scanning light L reflected by a mirror mounted in the filter selecting device 36 to the photosensitive drum 3 and a color image sensor 38 which receives the scanning light L having passed through the mirror of the filter selecting device 36, etc. The optical system 27 scans the document D when the scanner 30 moves in the forwarding direction, thereby to expose the photosensitive drum 3.

The scanner 30 is comprised of a first slider 31 with an exposure lamp 33, a mirror 34 and a detecting piece 39 and, a second slider 32 with mirrors 35*a*, 35*b*. During the scanning time of the document D, the first slider 31 is forwarded at a speed V/n (V is a peripheral velocity of the photosensitive drum 3 and n is the copying magnification), while the second slider 32 is driven forward by a scan motor 29 at a speed V/2n. A home position which is the stopping position of the scanner 30 is detected when a home switch 74 constituted by a photosensor is shut off by the detecting piece 39 and turned ON. The filter selecting device 36 has a half mirror 36ND (the ratio of the transmission and reflection is 6:4) and three filter mirrors 36YB, 36MG, 36CR arranged radially around a shaft 36*a* with 90 degrees from each other. The mirrors are selectively switched through rotation. Each of the filler mirrors 36YB, 36MG, 36CR is a unit of a mirror and a filter obtained by vapor-depositing a color separation filter of blue (B), green (G), red (R) to a mirror surface, and is used corresponding to the respective color of toners, i.e., Y, M, C.

During exposing and scanning for formation of an image, a reflecting surface of the selected mirror is so positioned as to incline approximately 10 degrees in the clockwise direction to a vertical surface, thereby the scanning light L is guided to an exposing point of the photosensitive drum 3. Moreover, during preparatory scanning to read the image of the document D prior to the above exposing and scanning for image formation, the half mirror 36ND is selected and positioned to be orthogonal to a direction of incidence of the scanning light L so as to improve the image forming ability of the color image sensor 38. A rotating position detecting sensor 77 determines the home position of the filter selecting device 36. FIG. 1 illustrates the state where the filter mirror 36CR is selected and positioned. In the following description, the half mirror 36ND and filter mirrors 36YB, 36MG, 36CR will sometimes be denoted respectively as an ND filter, a B filter, a G filter, an R filter in relation to the color separation characteristics thereof. The color image sensor 38 is formed of three arrays of many photodetecting elements aligned in a main scanning direction. The R, G, B filters are provided in the first, second and third arrays, respectively. One photodetecting element corresponds to one pixel of the image of the document. From each photodetecing element, a photoelectric conversion signal SO corresponding to the intensity of the reflecting light to one color of pixels is fed to an image processing part 100 as a document information.

Meanwhile, in the lower part of the copying machine 1, there are provided an upper paper cassette 42 and a lower paper cassette 43 where papers P are accommodated. A paper feed port 41 is opened at the left side face of the copying machine 1 through which the paper P is manually fed by opening a door 41*a*. These paper cassettes 42, 43 and paper feed port 41 are alternatively used. The paper cassettes 42, 43 are equipped with pickup rollers 44, 45 for taking out the papers P one by one, paper size sensors 81, 82 to detect the size of the papers P and paper empty sensors 83, 84 to detect the shortage of the papers P, respectively. A sensor 87 provided at the paper feed port 41 detects when the paper P is inserted.

The paper P drawn out from the paper cassette 42 is transferred to a timing roller 46 by a paper feed roller 47, and the paper P drawn out from the paper cassette 43 is guided by the paper feed rollers 48, 47 to the timing roller 46. The paper P stands by at the timing roller 46. On the other hand, the paper inserted through the paper feed port 41 is carried to the timing roller 46 by a feed roller 49. The presence or absence of the paper P at a feed route R1 between the paper feed roller 47 and timing roller 46 is detected by a paper sensor 85 provided in the vicinity of the paper feed roller 47. Moreover, a timing sensor 86 in the vicinity of the timing roller 46 detects a front end of the passing paper P. The waiting paper P is transported through rotation of the timing roller 46 in synchronism with the transfer belt 11, and a toner image is transferred to the paper P from the transfer belt 11 at the transfer position (secondary transfer). Thereafter, the paper P is sent to a fixing unit 51 by a conveyor belt 50 of the straight length corresponding to papers of A4 size.

The fixing unit 51 is constituted by an upper roller 52 with two heater lamps 54, 55, a lower roller 53 with one heater lamp 56 and a temperature sensor 91 formed of a thermister arranged in the vicinity of the upper roller 52, and the like. The toner image is melted and fixed to the paper P at the fixing unit 51. The paper P is, after a desired copying image is formed thereon through fixing of the toner image, sent to a sorter 2 by a discharger roller 57 which has a discharge sensor 88 arranged in the vicinity thereof to detect a rear end of the passing paper P, to be discharged to a storing tray 61 or a sorting bin 62.

When an image is to be copied again on the copied surface or a non-copied surface of the copied paper P, a switch lever 59 between the fixing unit 51 and discharge roller 57 is moved to feed the paper P to a re-feed route R2 below the conveyor belt 50. In order to copy onto the same copied surface, the copied paper P fed to the re-feed route R2 through rotation of the rollers 52, 53 and movement of the switch lever 59 is sent to the timing roller 46 within the re-feed route R2 while the copied surface is turned downward. On the other hand, in order to copy onto a different surface other than the copied surface, the copied paper P is transported by the rotation of the rollers 52, 53 and discharge rollers 57 until the rear end of the paper P reaches the discharge roller 57, and after the switch lever 59 is moved, the discharge roller 57 is rotated in a reverse direction to feed the paper P to the re-feed route R2. The copied paper P is thus transported to the timing roller 46 while the copied surface thereof is turned upward.

In FIG. 1, references 24, 25 and 26 respectively represent a main motor for driving each part related mainly to the supply and conveyance of the paper P, a PC motor for driving the photosensitive drum 3 and transfer belt 11 or the like, and a cooling fan.

In the copying machine 1 of the above-described structure, it is possible to obtain a mono-color copying image by toners of a single color Y, M, C or BK, a synthetic mono-color copying image R (Y and M), G(Y and C) or B(M and C) obtained by overlapping toner images of two different colors, among the three primary colors Y, M, C, and a full-color copying image obtained by overlapping toner images of three primary colors.

In order to form the mono-color image and synthetic mono-color image, the half mirror 36ND is used to expose and scan the document D and a latent image formed on the photosensitive drum 3 is developed by one of the developers 6–9 other corresponding to the designated color, and the toner image is transferred to the transfer belt 11. Further, for obtaining the synthetic mono-color copying image, the same document D is exposed and scanned again by the half mirror 35ND, and the toner image developed by a different developer 6–9 than the previous one is transferred onto the transfer belt 11, whereby the toner images of two colors are overlapped on the transfer belt 11. On the other hand, in order to form the full-color image, toners of four colors in which BK being added to Y, M, C are sequentially used to enhance the reproducibility or reality of the black portion of the image. In other words, the same document D is exposed and scanned four times. The B, G, R, ND filters and developers 6–9 are selectively switched every scanning time and the latent images subjected to color separation from the document D are formed and developed on the photosensitive drum 3. The toner images are sequentially transferred to the transfer belt 11, and overlapped one after another thereon.

It is necessary to transfer the toner images onto the same position of the transfer belt 11 when the toner images are overlapped (referred to as a multiple transfer hereinafter). Therefore, according to the copying machine 1 of the embodiment, it is so arranged that the scanner 30 is started to be driven when the belt mark 11*a* of the transfer belt 11 is detected, thereby controlling the starting timing of formation of the latent images on the photosensitive drum 3.

When the full-color image is formed, the image of the document D is distinguished between a color image part including colored portions and a monochrome image part composed only of uncolored portions at the preparatory scanning. Accordingly, when images of each toner, Y, M, C are formed, the latent image corresponding to the monochrome image part is erased by the editing eraser 5 prior to the development. When the image of BK toner is formed, in contrast, the latent image corresponding to the color image part is erased before development. That is, the color image part is reproduced by the multiple transfer of each toner, Y, M, C and the monochrome image part is reproduced by only the BK toner. A clear copying image can be obtained in this manner as above without minute shift of colors from a character which is generally expressed in black or an image with small line width such as a line drawing, etc. and at the same time, it becomes possible to reproduce the natural color of a multi-color image, for example, a color picture.

Figure 2:
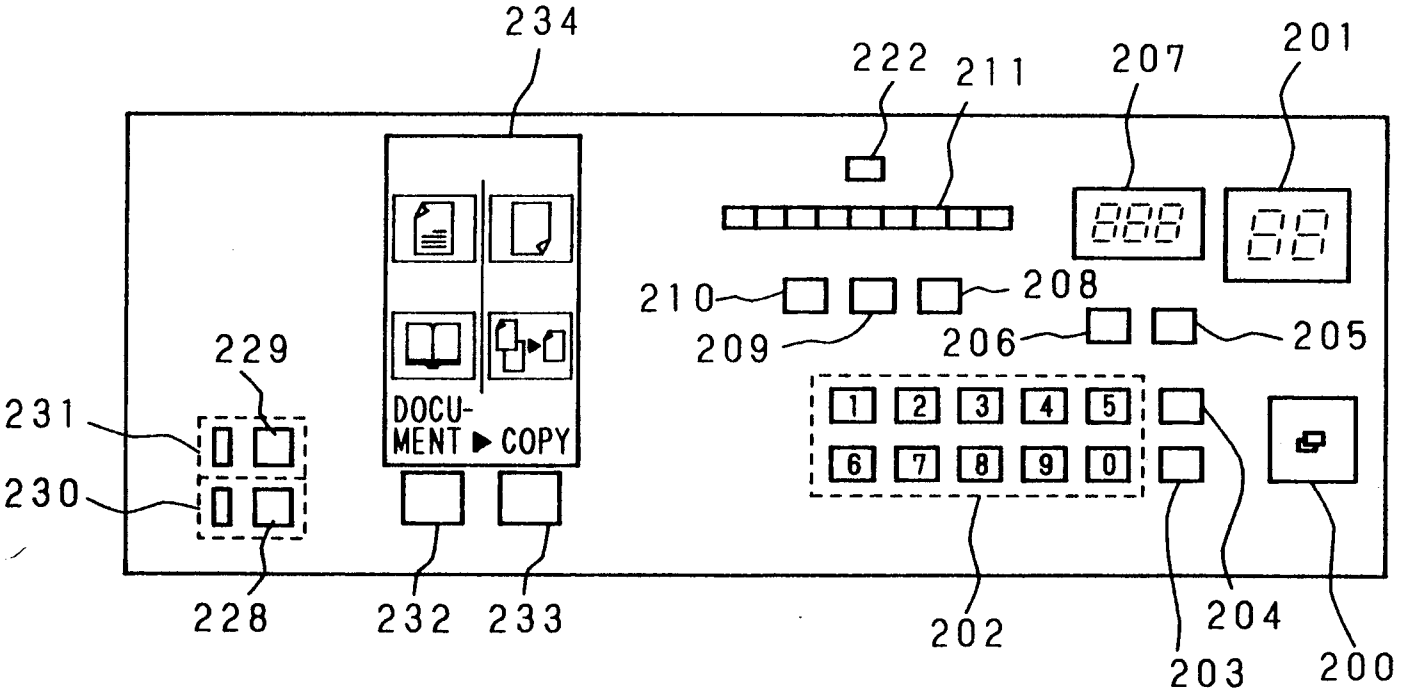
FIG. 2 is a plan view showing the structure of an operating panel.

An operating panel is mounted at the front side on the upper surface of the copying machine 1. FIG. 2 is a plan view of the layout of the operating panel. A print switch 200 is provided at the lower right part of the operating panel to start copying. A clear spot key 203, an interruption key 204 and a ten key 202 are at the left side of the print switch 200. The ten key 202 is used to input various kinds of information, e.g., the number of papers to be copied and the like. An LED 201 of seven segments is provided at the upper portion of the print switch 200 to indicate the number of papers in copying progress, with an LED 207 of seven segments being provided at the belt side to indicate the copying magnification. Besides, an up key 205 and a down key 206 for setting the magnification, an automatic exposure key 209, a manual up key 208 and manual down key 210 for manually changing the exposure amount, an exposure level indicating LED 211 and an automatic exposure selection indicating LED 222 are provided at the upper portion of the ten key 202.

A mode selection key and a mode indicating LED are mounted at the left side of the operating panel. Concretely, there are a selection key 228 to select monochrome copy mode, an indicating LED 230 to indicate when the monochrome copy mode is selected, a selection key 229 to select a full-color copy mode, an indicating LED 231 to indicate the selection of the full-color copy mode, a document selection button 232 to select a one-face or book-type document, a copy mode selection button 233 to set a one-face or a synthetic copy mode and an indicating part 234. If the dividing copy mode is desired, the document selection button 232 should be pressed to select a book-type document and the copy mode selection button 233 is switched to select the one-face copy mode. Consequently, the spread space is divided and transferred to two papers P.

Figure 3:
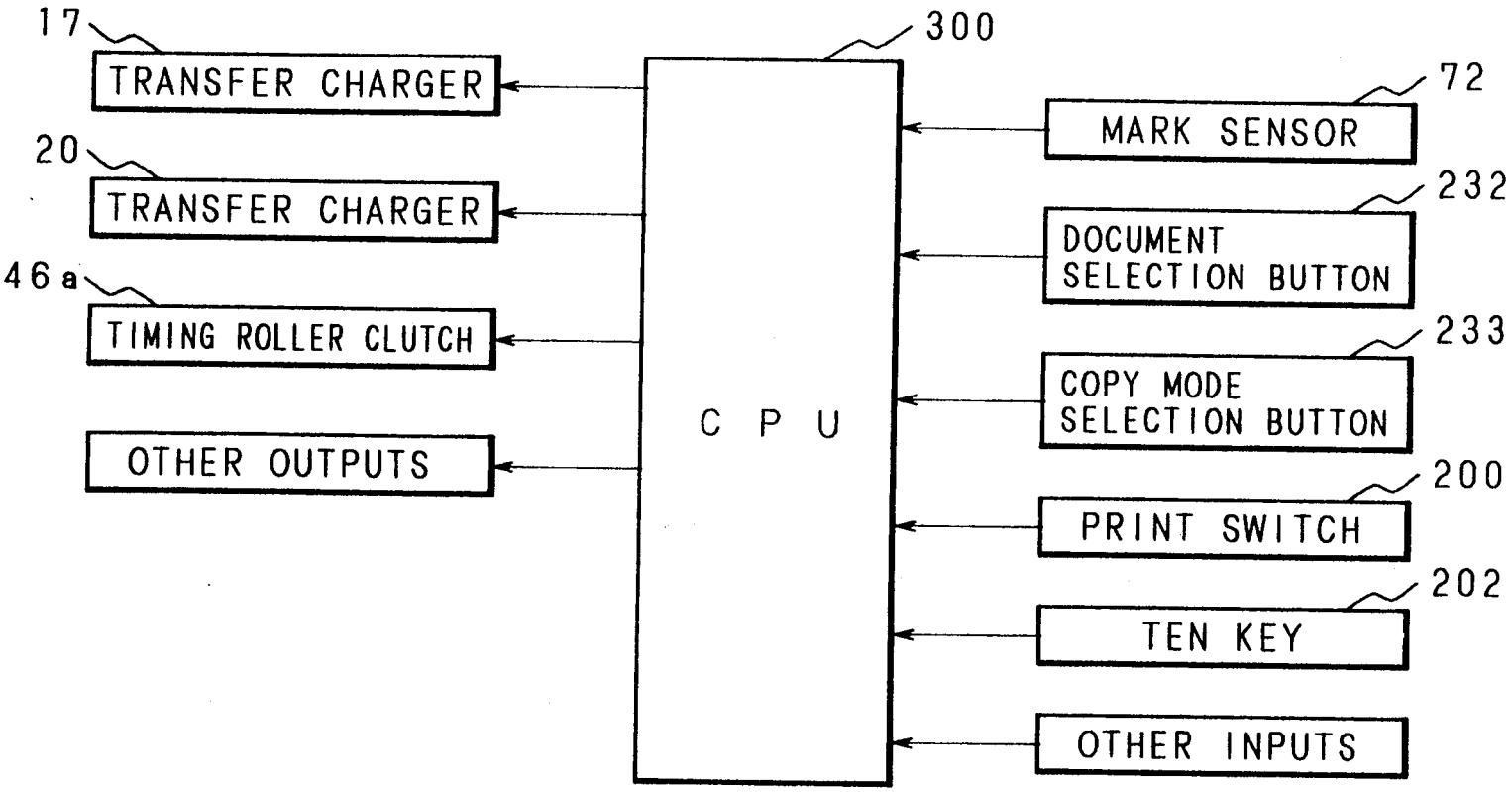
FIG. 3 is a structural block diagram of a controlling system.

FIG. 3 is a block diagram showing the structure of a control system to control the copying machine 1. The copying machine 1 is controlled by a microcomputer (referred to as a CPU hereinafter) 300. Signals from a mark sensor 72, print switch 200, ten key 202, document selection button 232, copy mode selection button 233 and the other key inputs and various kinds of detecting signals are input to the CPU 300. In response to the input signals, the CPU 300 generates an output signal to the transfer chargers 17, 20, a clutch 46a of the timing roller 46 and the other elements and devices, thereby to control the same.

The copying machine 1 operates in the manner as follows.

Figure 4:
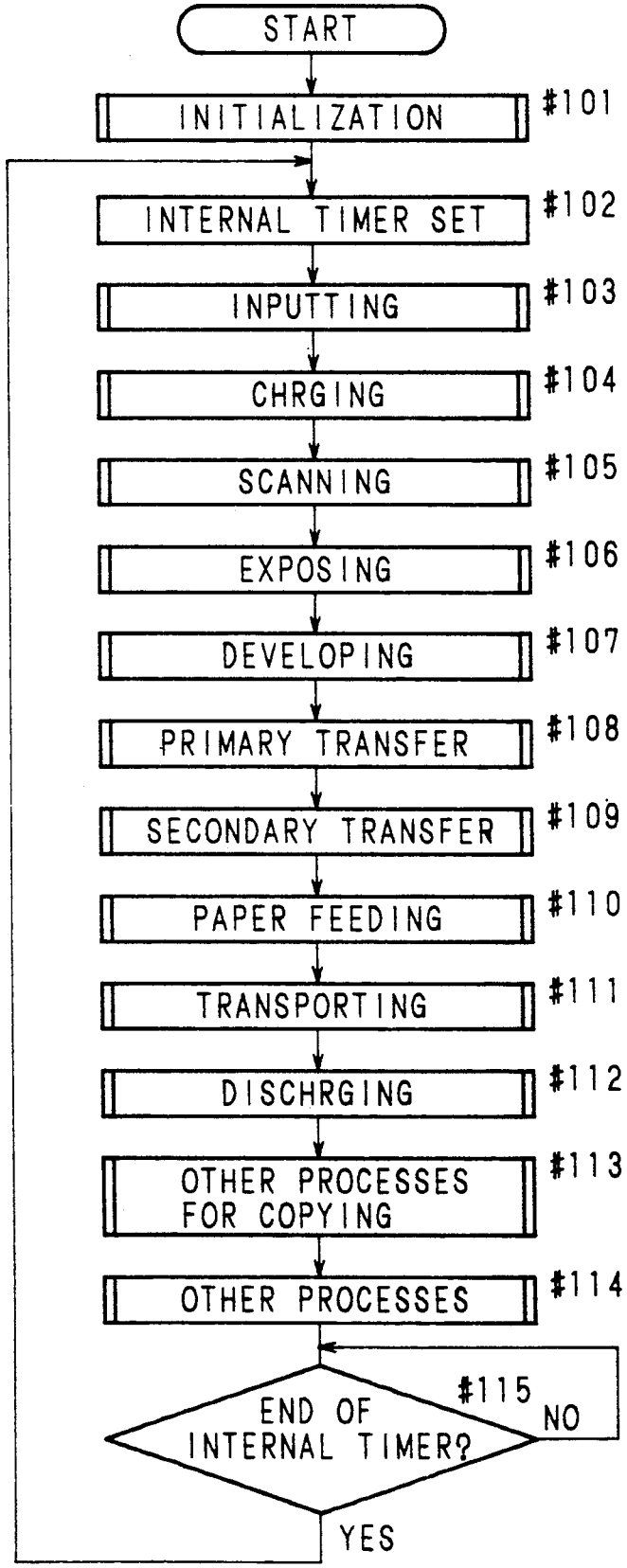
FIG. 4 is a flow chart of a main routine of a CPU.

Referring to a flow chart of FIG. 4 showing a main routine of the CPU 300, when the power switch is turned ON to start the program, an internal RAM of the CPU 300 is cleared and a register and a timer, etc. are initialized (step #101). The inner timer is set to determine the length of one routine of the CPU 300 (step #102). Then, signals corresponding to key inputs through the operating panel and various sensors are processed (step #103), and necessary procedures for steps #104–#112 are performed in accordance with the result of step #103.

First, a grid voltage of the electrostatic charger 4 and the ON/OFF timing of the outputs thereof are controlled in the charging process in order to charge the photosensitive drum 3 (step #104). The scanning process at the scanning time and returning time of the scanner 30 is carried out (step #105). An output voltage of the exposure lamp 33 and the lighting timing thereof are controlled to expose and scan a document in the exposing process (step #106). Then, the developer 6–9 of the color designated in the developing process is driven or stopped, toners are supplied and the shortage of toners is detected, etc. (step #107). After completing the development, the transfer charger 17 is controlled to be turned ON/OFF so that a toner image on the photosensitive drum 3 is transferred onto the transfer belt 11 in the primary transfer process (step #108). Then, the transfer charger 20 is controlled to be turned ON/OFF so that the toner image transferred onto the transfer belt 11 is transferred to the paper P in the secondary transfer process (step #109).

The pickup roller 44, 45 or 49 of the paper cassette 42, 43 or paper feed port 41 is alternatively selected in the paper feeding process, thereby the paper P is supplied (step #110). The paper P is sequentially transported through ON/OFF control of the timing roller 46, paper feed rollers 47, 48 and conveyor belt 50, etc. in the transporting process (step #111). When the paper P passes the discharge roller 57, it is discharged on the basis of on the detected result of the discharge sensor 88 in the discharging process (step #112). Subsequently, procedures necessary for copying other than those in the foregoing steps, for example, cleaning process, side erasing process, main erasing process and the like are conducted (step #113). Other procedures not directly related to the copy operation, such as temperature control of the fixing unit 51, display of LED on the operating panel and so on, are conducted (step #114).

Thereafter, it is checked whether the inner timer is finished (step #115). The flow is not returned to the step #102 until the inner timer is complete. The procedures in the steps #102–#114 are repeated for a fixed term until the power supply is cut.

Before the details of the aforementioned procedures, the setting time of the timer will be explained below.

A time T0 is a time necessary for the transfer belt 11 to rotate one round. A time T1 is a time necessary for the image section to pass through each procedure such as the discharging process, exposing process, developing process, transfer process, etc. Moreover, a timer T2 is required for the copying section to pass through each procedure. An equation $T2=T\frac{1}{2}$ is held in the case of the book dividing copy mode. Moreover, times t2, t3, t4, t5, t6 represent respectively moving times from the charging point to the exposing point, from the exposing point to the developing point, from the exposing point to the primary transfer point, from the primary transfer point to the secondary transfer point and a time expressed by t5-(moving time of the paper P from the timing roller 46 to the secondary transfer point).

Figure 5:
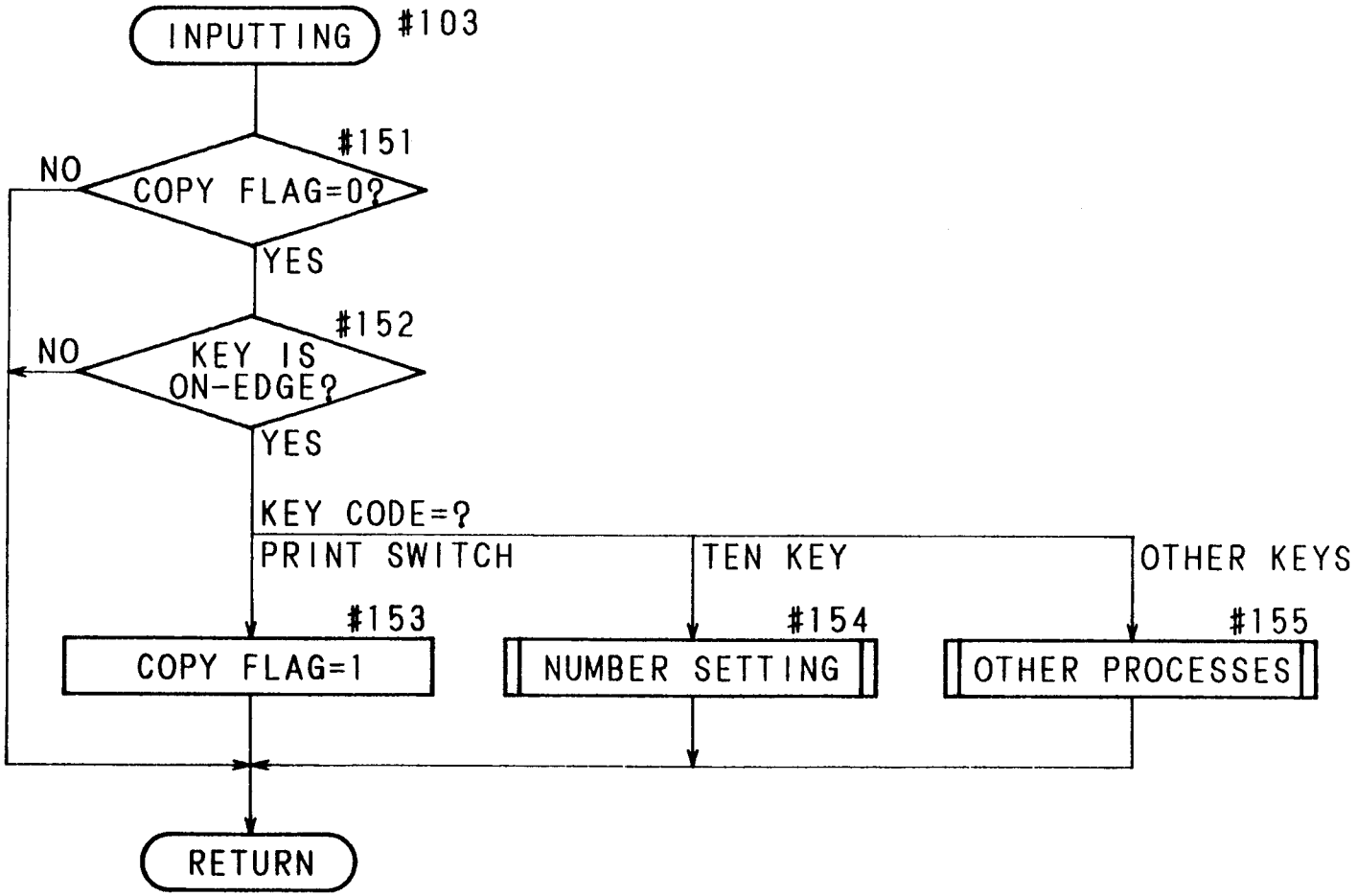
FIG. 5 is a flow chart showing the content of the inputting process of FIG. 4.

FIG. 5 is a flow chart showing the content of the inputting process in the step #103. A copy flag is checked (step #151) and, when the copy flag is 0, it is checked whether any of the keys and switches on the operating panel is manipulated (step #152). If some key or switch is depressed, what is the key or switch is detected. If the print switch 200 is depressed, the copy flag is set to 1 (step #152). On the other hand, if the ten key 202 is depressed, the corresponding procedure is performed (step #154). When the other key other than the above print switch and ten key is turned, the procedure corresponding to the key is carried out (step #155). In the case where the copy flag is 1 in the step #151 and neither key is found to be depressed in the step #152, the flow is returned to the main routine.

Figure 6:
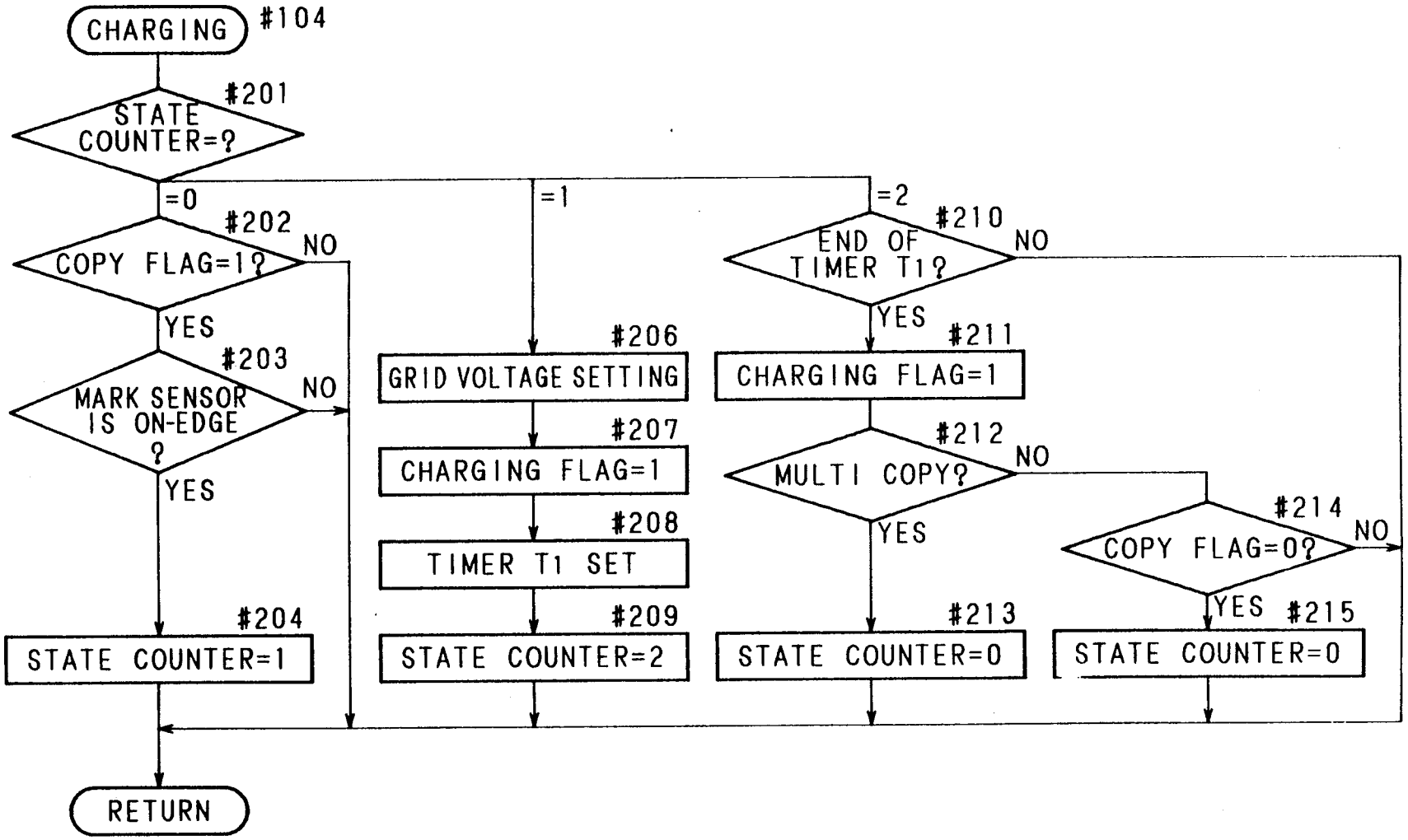
FIG. 6 is a flow chart showing the content of the charging process of FIG. 4.

FIG. 6 is a flow chart showing the content of the charging process in the step #104. The value of a state counter (initial value 0) indicative of the controlling state is checked in the first place (step #201). When the state counter indicates 0, the copy flag is checked (step #202). When the copy flag is 1, it is detected whether or not the mark sensor 72 is on edge, that is, the timing when the belt mark 11a of the transfer belt 11 passes the mark sensor 72 is detected (step #203). Upon detection of the belt mark 11a passing the mark sensor 72, the state counter is set to 1 (step #204), to return the flow once to the main routine. The procedure when the state counter is 1 is processed at a next routine. If the copy flag is 0 in the step #202, or the mark sensor 72 is not on edge in the step #203, nothing is performed, with the flow returning to the main routine. When the state counter is 1, the grid voltage is set to a predetermined value (for example, −600V) (step #206) and the charge flag is set to 1 to start charging (step #207). A timer T1 is set to determine the charging time (step #208). Then, the state counter is set to 2 (step #209), and the flow is returned to the main routine. The procedure when the state counter indicates 2 is effected at a next routine. Specifically, when the state counter is 2, it is checked whether the timer T1 is finished (step #210). Although the flow is returned to the main routine if the timer is not finished, the charging flag is reset to 0 thereby to stop charging when the timer T1 is finished (step #211). Thereafter, it is discriminated whether a multi copy, that is, copying onto a plurality of papers from one document is ordered through the ten key 202 (step #212). In the case where the multi copy is required, the state counter is reset to 0 (step #213) and the flow is returned to the main routine and charging process is performed for next copying in a next routine. If the multi copy is not ordered, the copy flag is checked (step

#214). When the copy flag is 0, i.e., copying is completed, the state counter is reset to the initial value 0 (step #215) and the flow is moved back to the main routine. If the copy flag is not 0, the flow is directly returned to the main routine from the step #214.

Figure 7:
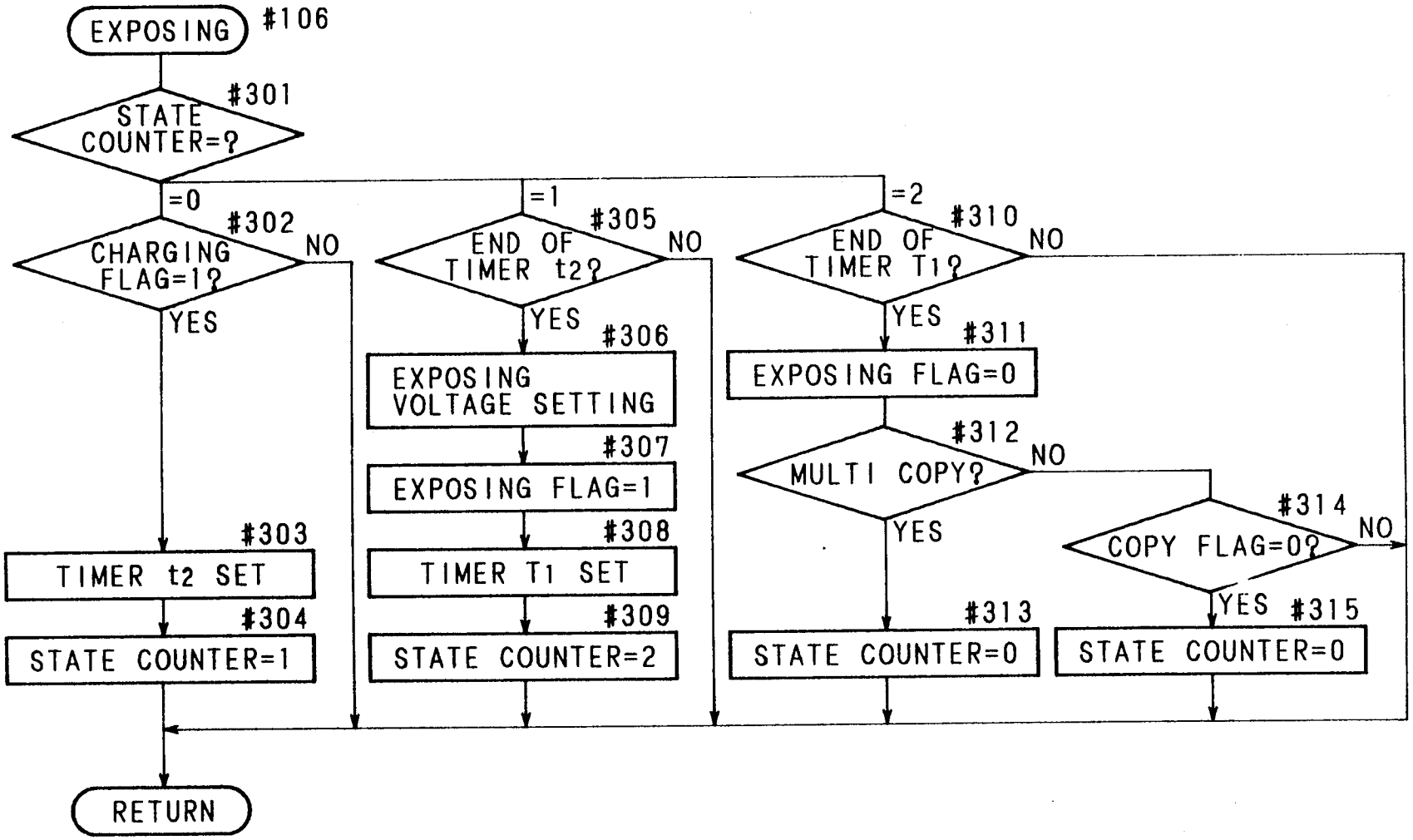
FIG. 7 is a flow chart showing the content of the exposing process of FIG. 4.

FIG. 7 is a flow chart showing the content of the exposing process in the step #106. The value of a state counter (initial value 0) indicative of the controlling state is checked in the first place (step #301). When the state counter indicates 0, the charging flag is checked, that is, it is detected whether or not the charging process is started after detection of the belt mark 11*a* (step #302). When the charging flag is 1, a timer t2 is set to determine a start timing of exposing (step #303), the state counter is set to 1 (step #304), to return the flow once to the main routine. The procedure when the state counter is 1 is processed at a next routine. When the state counter is 1, it is detected whether or not the timer t2 is ended (step #305). If it is ended, the exposing voltage is set to a predetermined value (step #306) and the exposing flag is set to 1 to start exposing (step #307). A timer T1 is set to determine the exposing time (step #308). Then, the state counter is set to 2 (step #309), and the flow is returned to the main routine. The procedure when the state counter indicates 2 is effected at a next routine. Specifically, when the state counter is 2, it is checked whether the timer T1 is finished (step #310). Although the flow is returned to the main routine if the timer T1 is not finished, the exposing flag is reset to 0, thereby exposing is stopped when the timer T1 is finished (step #311). Thereafter, it is discriminated whether a multi copy is ordered through the ten key 202 (step #312). In the case where the multi copy is required, the state counter is reset to 0 (step #313) and the flow is returned to the main routine and exposing process for next copying is performed in a next routine. If the multi copy is not ordered, the copy flag is checked (step #314). When the copy flag is 0, i.e., copying is completed, the state counter is reset to the initial value 0 (step #315) and the flow is moved back to the main routine. If the copy flag is not 0, the flow is directly returned to the main routine.

Figure 8:
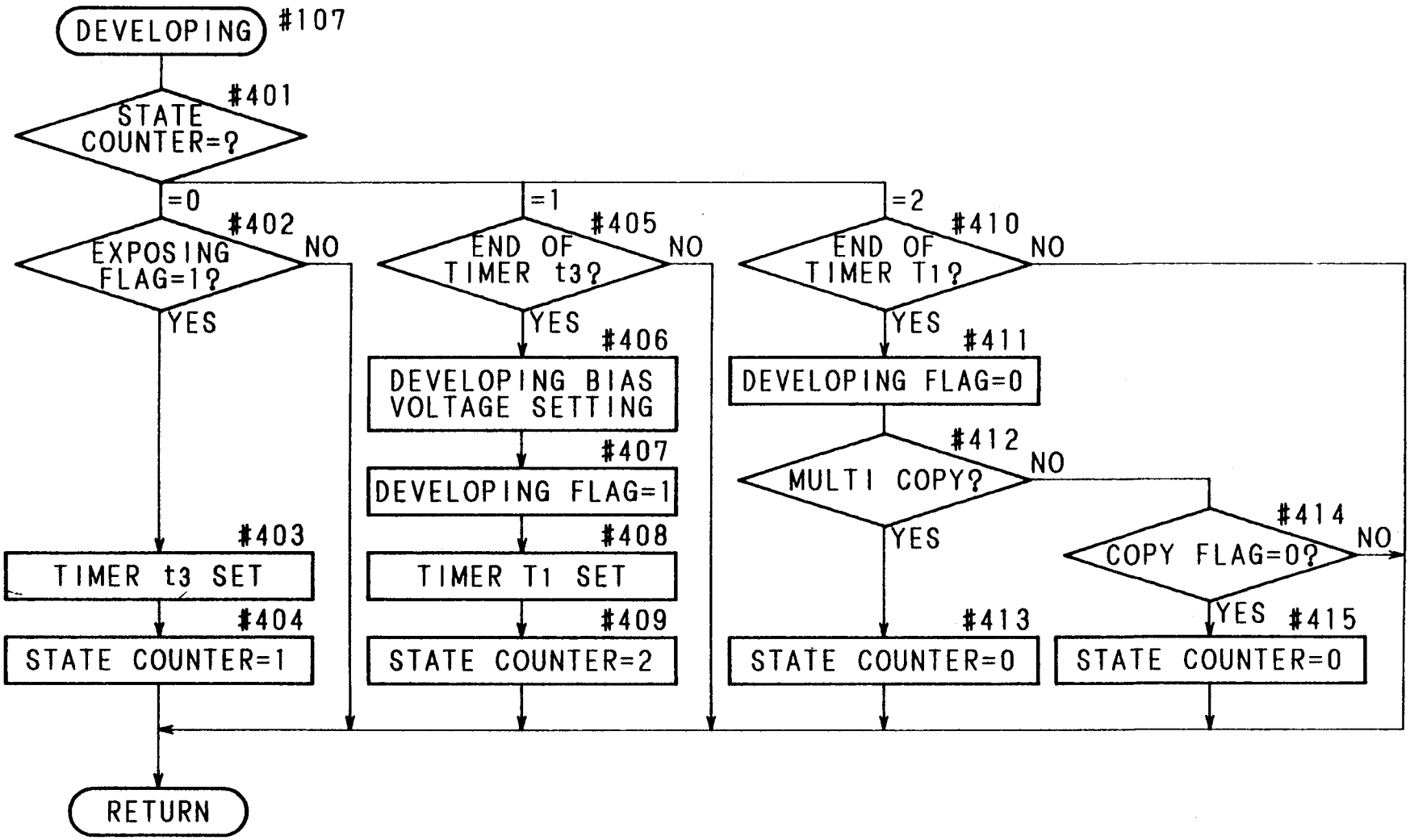
FIG. 8 is a flow chart showing the content of the developing process of FIG. 4.

FIG. 8 is a flow chart showing the content of the developing process in the step #107. The value of a state counter (initial value 0) indicative of the controlling state is checked in the first place (step #401). It is detected whether the exposing flag is 1 that is, whether or not the exposing process is started after end of the timer t2 (step #402). When the exposing flag is 1, a timer t3 is set to determine a start timing of developing (step #403), the state counter is set to 1 (step #404), to return the flow once to the main routine. The procedure when the state counter is 1 is processed at a next routine. When the state counter is 1, it is detected whether or not the timer t3 is ended (step #405). If it is ended, the developing bias voltage is set to a predetermined value (step #406) and the developing flag is set to 1 to start developing (step #407). A timer T1 is set to determine the developing time (step #408). Then, the state counter is set to 2 (step #409), and the flow is returned to the main routine. The procedure when the state counter indicates 2 is effected at a next routine. Specifically, when the state counter is 2, it is checked whether the timer T1 is finished (step #410). Although the flow is returned to the main routine if the timer is not finished, the developing flag is reset to 0 thereby to stop developing when the timer T1 is finished (step #411). Thereafter, it is discriminated whether a multi copy is ordered through the ten key 202 (step #412). In the case where the multi copy is required, the state counter is reset to 0 (step #413) and the flow is returned to the main routine and developing process for next copying is performed in a next routine. If the multi copy is not ordered, the copy flag is checked (step #414). When the copy flag is 0, i.e., copying is completed, the state counter is reset to the initial value 0 (step #415) and the flow is moved back to the main routine. If the copy flag is not 0, the flow is directly returned to the main routine.

Figure 9:
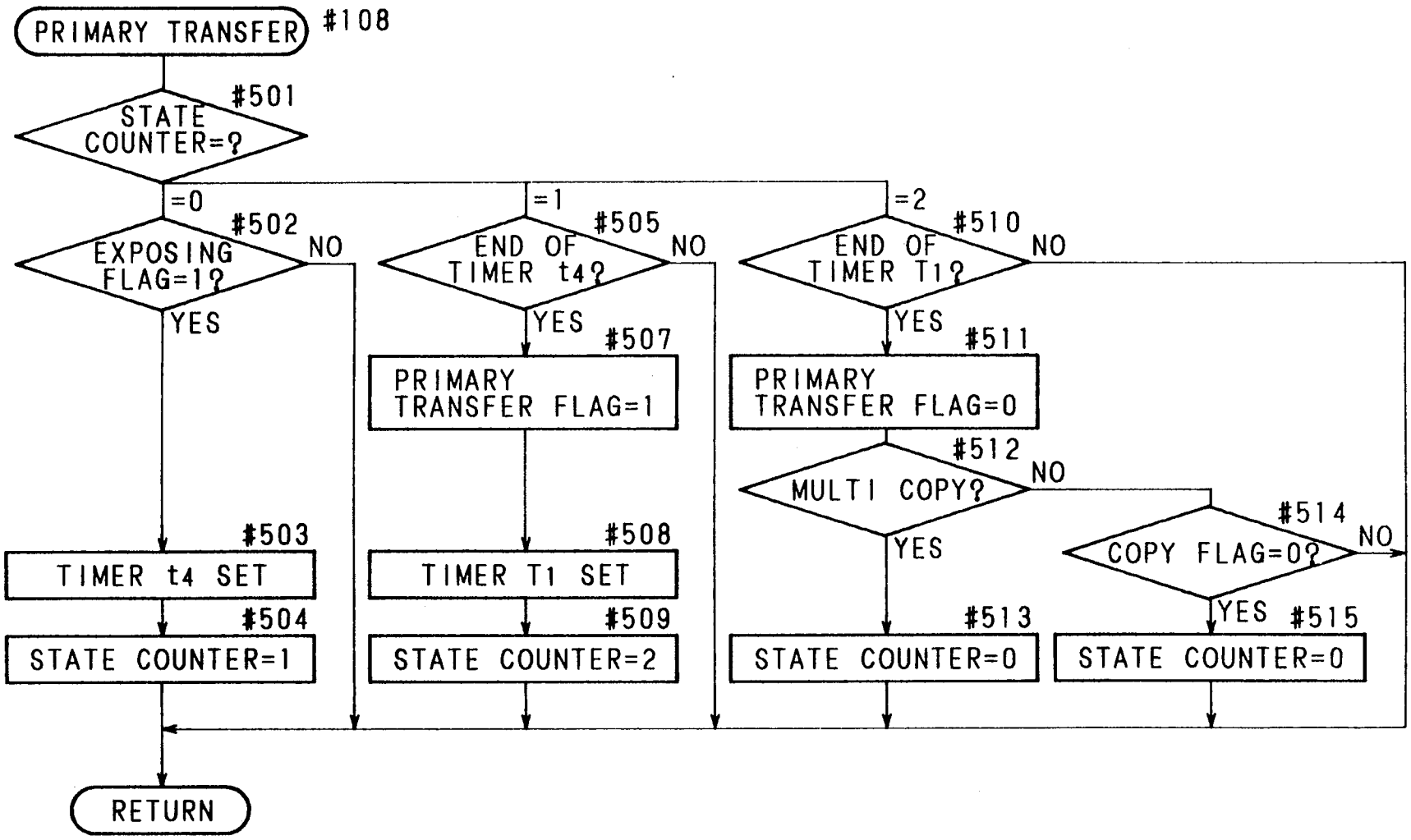
FIG. 9 is a flow chart showing the content of the primary transfer process of FIG. 4.

FIG. 9 is a flow chart showing the content of the primary transfer process in the step #108. The value of a state counter (initial value 0) indicative of the controlling state is checked in the first place (step #501). When the state counter indicates 0, the exposing flag is checked, (step #502). When the exposing flag is 1, a timer t4 is set to determine a start timing of primary transfer (step #503), the state counter is set to 1 (step #504), to return the flow once to the main routine. The procedure when the state counter is 1 is processed at a next routine. When the state counter is 1, it is detected whether or not the timer t4 is ended (step #505). If it is ended, the primary transfer flag is set to 1 to start primary transfer (step #507). A timer T1 is set to determine the primary transfer time (step #508). Then, the state counter is set to 2 (step #509), and the flow is returned to the main routine. The procedure when the state counter indicates 2 is effected at a next routine. Specifically, when the state counter is 2, it is checked whether the timer T1 is finished (step #510). Although the flow is returned to the main routine if the timer T1 is not finished, the primary transfer flag is reset to 0 thereby to stop primary transfer when the timer T1 is finished (step #511). Thereafter, it is discriminated whether a multi copy is ordered through the ten key 202 (step #512). In the case where the multi copy is required, the state counter is reset to 0 (step #513) and the flow is returned to the main routine and primary transfer process for next copying is performed in a next routine. If the multi copy is not ordered, the copy flag is checked (step #514). When the copy flag is 0, i.e., copying is completed, the state counter is reset to the initial value 0 (step #515) and the flow is moved back to the main routine. If the copy flag is not 0, the flow is directly returned to the main routine.

Figure 10A:
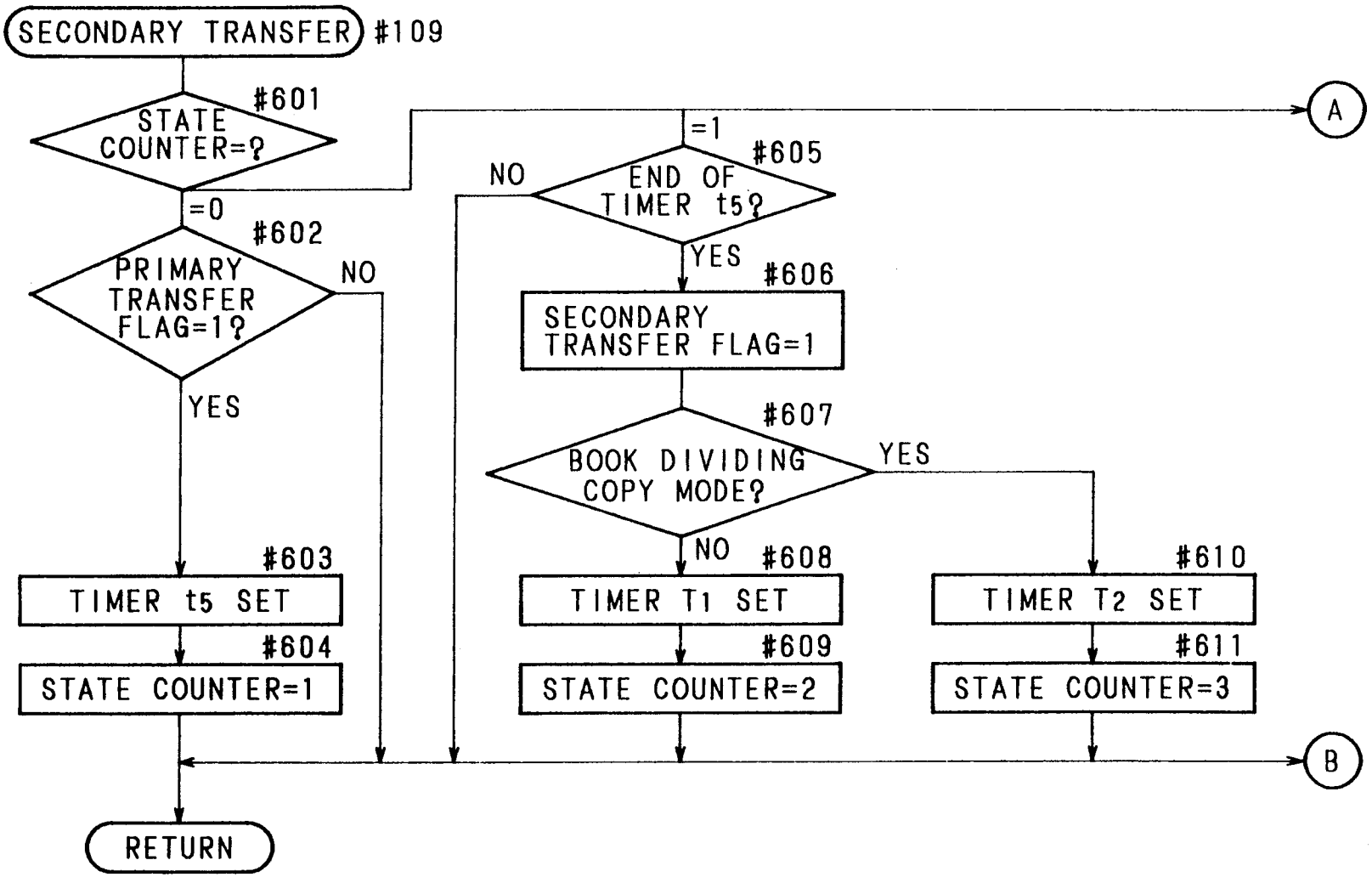
FIG. 10(*a*), 10(*b*) and 10(*c*) are flow charts showing the content of the secondary transfer process of FIG. 4.
Figure 10B:
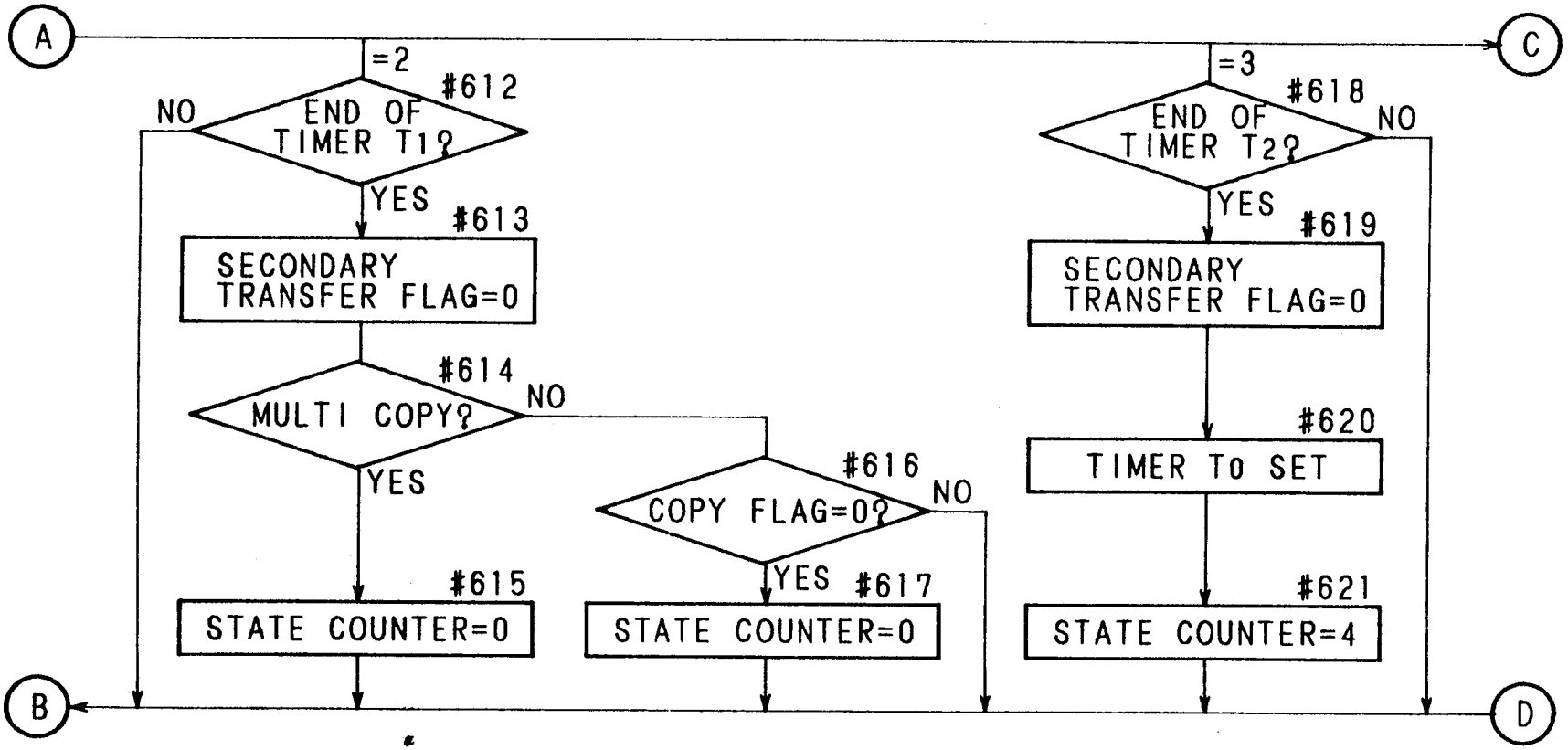
Figure 10C:
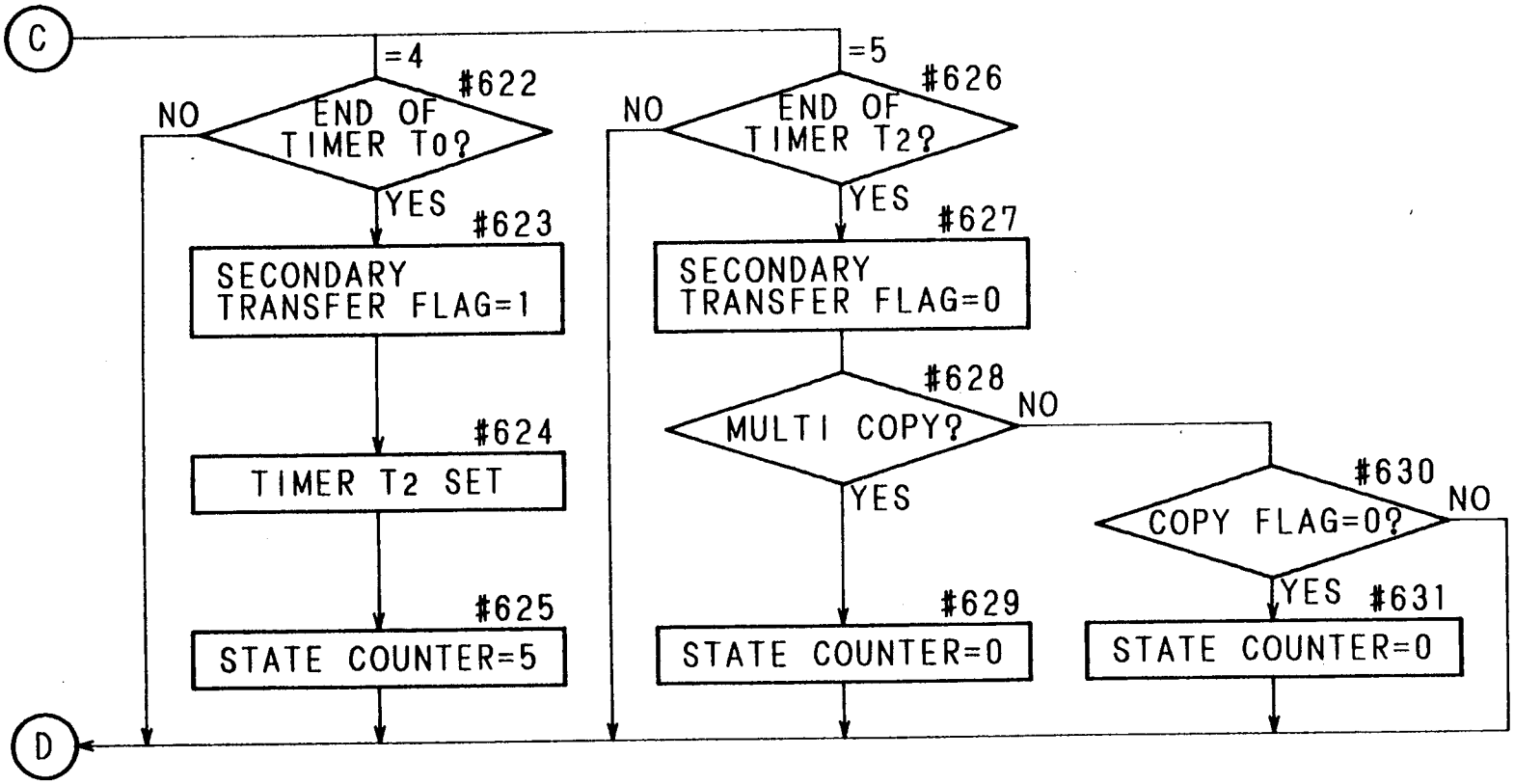

FIG. 10(*a*) and 10(*b*) are flow charts showing the content of the secondary transfer in the step #109 of FIG. 4. When the value of the state counter (initial value 0) is checked (step #601) to be found 0, the primary transfer flag is checked (step #602). When the primary transfer flag is 1, namely, during the primary transfer, the timer t5 is set to determine the starting timing of the secondary transfer (step #603) and the state counter is set to 1 (step #604). The flow is returned to the main routine once at this time. The procedure when the state counter is 1 is performed at a next routine. Whether the timer t5 is ended is detected when the state counter is 1 (step #605). If the timer t5 is ended, the secondary transfer flag is set to 1 to start the secondary transfer (step #606). It is subsequently checked through the inputting state of the document selection button 232 and copy mode selection button 233 whether the book dividing copy mode is not selected or not (step #607). When the book dividing copy mode is not selected, the timer T1 is set to achieve the secondary transfer for all over the length of the image (step #608). Then, the state counter is set to 2 (step #609) and the flow is returned to the main routine. At a next routine, the procedure when the counter is 2 is processed. In the meantime, when the book dividing copy mode is selected, the timer T2 is set, thereby enabling the secondary transfer for only half the length of the total image (step #610). The state counter is then set to 3 (step #611) and the flow returns to the main routine. The procedure when the state counter indicates 3 is processed at a next routine. When the state counter is 2, the timer T1 is checked whether it is finished (step #612). If the timer T1 is unfinished, the flow returns to the main routine directly. When the timer T1 is complete, the secondary transfer flag is reset to 0 to end the secondary transfer (step #613). It is detected whether the multi copy is set through the ten key 202 (step #614) and when the multi copy is desired, the state counter is reset to the initial value 0 (step #615). The flow is returned to the main routine. The secondary transfer process for next copying will be carried out at a next routine. In the case where the multi copy is not ordered, the copy flag is checked (step #616). When the copy flag is 0, namely, copying is finished and the state counter is reset to the initial value 0 (step #617), with the flow returning to the main routine. In contrast, if the copy flag is not 0, the flow is returned to the main routine, skipping the step #617.

When the state counter is 3, completion of the timer T2 is checked (step #618). When the timer T2 is complete and it is judged that the secondary transfer for one page of the spread space of half the length of the total image is finished, the secondary transfer flag is reset to 0 (step #619). At the same time, the timer T0 is set to determine the starting timing of the transfer for the other page of the spread space (step #620). The state counter is set to 4 (step #621) and the flow is returned to the main routine. The procedure when the state counter is 4 is started at a next routine. When the state counter is 4, it is checked whether the timer T0 is finished (step #622). If the timer T0 is not terminated, the flow is returned to the main routine, whereas, if the timer T0 is finished, the secondary transfer flag is set to 1 to begin the secondary transfer of the other page of the spread space (step #623). Then, after the timer T2 is set so as to carry out the secondary transfer of half the length of the image (step #624), the state counter is set to 5 (step #625), with the flow returning to the main routine. The procedure when the state counter is 5 is started at a next routine. Specifically, when the state counter is 5, it is checked whether the timer T2 is finished (step #626). When it is detected that the timer T2 is finished and the secondary transfer of the other page is completed, the secondary transfer flag is reset to 0 (step #627) to complete the secondary transfer. It is detected then whether the multi copy is ordered (step #628). In the case where the multi copy is selected, the state counter is reset to the initial value, i.e., 0, (step #629) and the flow is returned to the main routine. The secondary transfer process for next copying is carried out at a next routine. If the multi copy is not selected, the copy flag is checked (step #630). When the copy flag is 0, namely, copying is finished, the state counter is reset to the initial 0 (step #631). Accordingly, the flow is moved back to the main routine. When the copy flag is not 0, the flow is directly returned to the main routine.

Figure 11A:
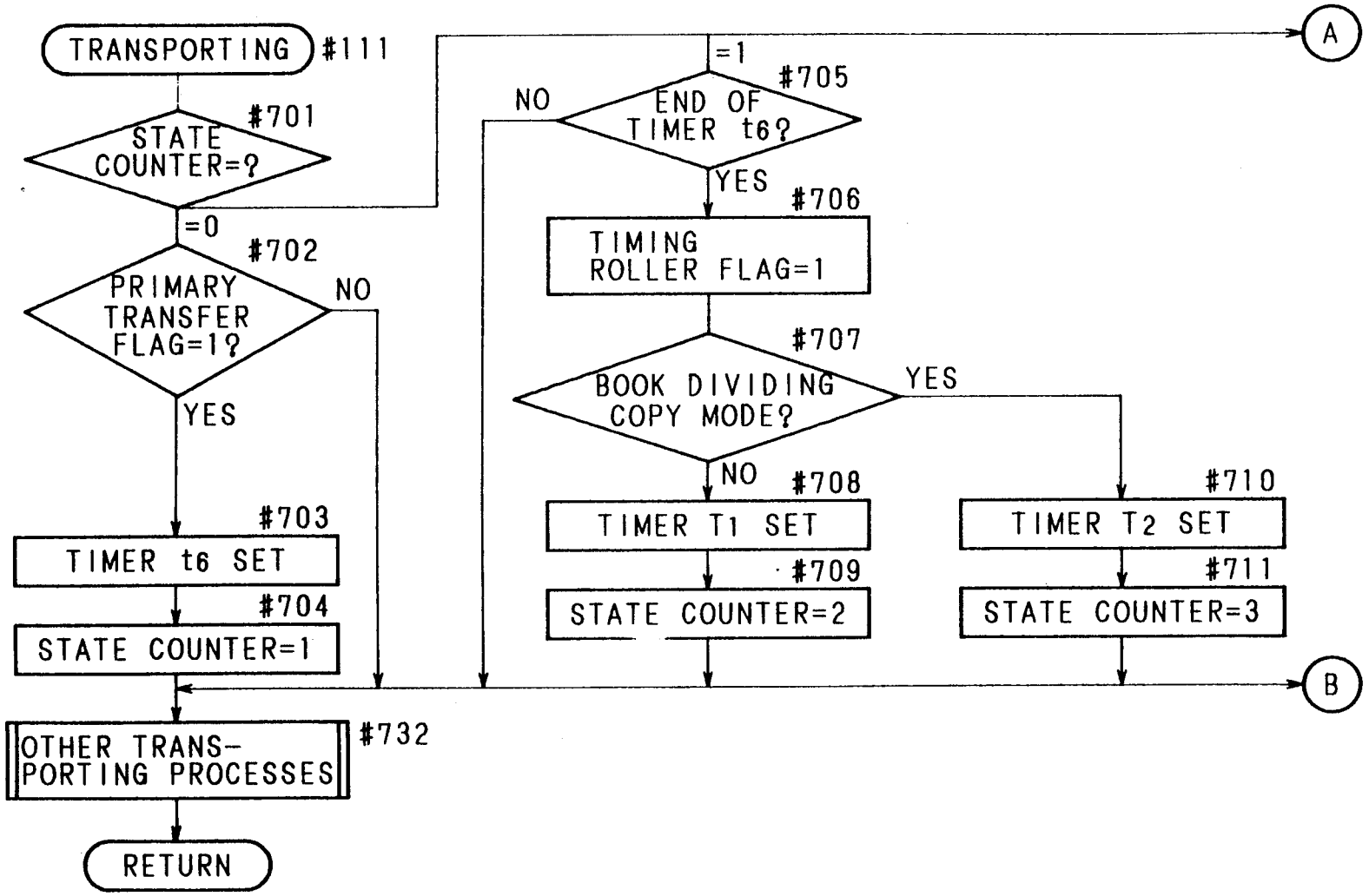
FIG. 11(*a*), 11(*b*) and 11(*c*) are flow charts showing the content of the exposing process of FIG. 4.
Figure 11B:
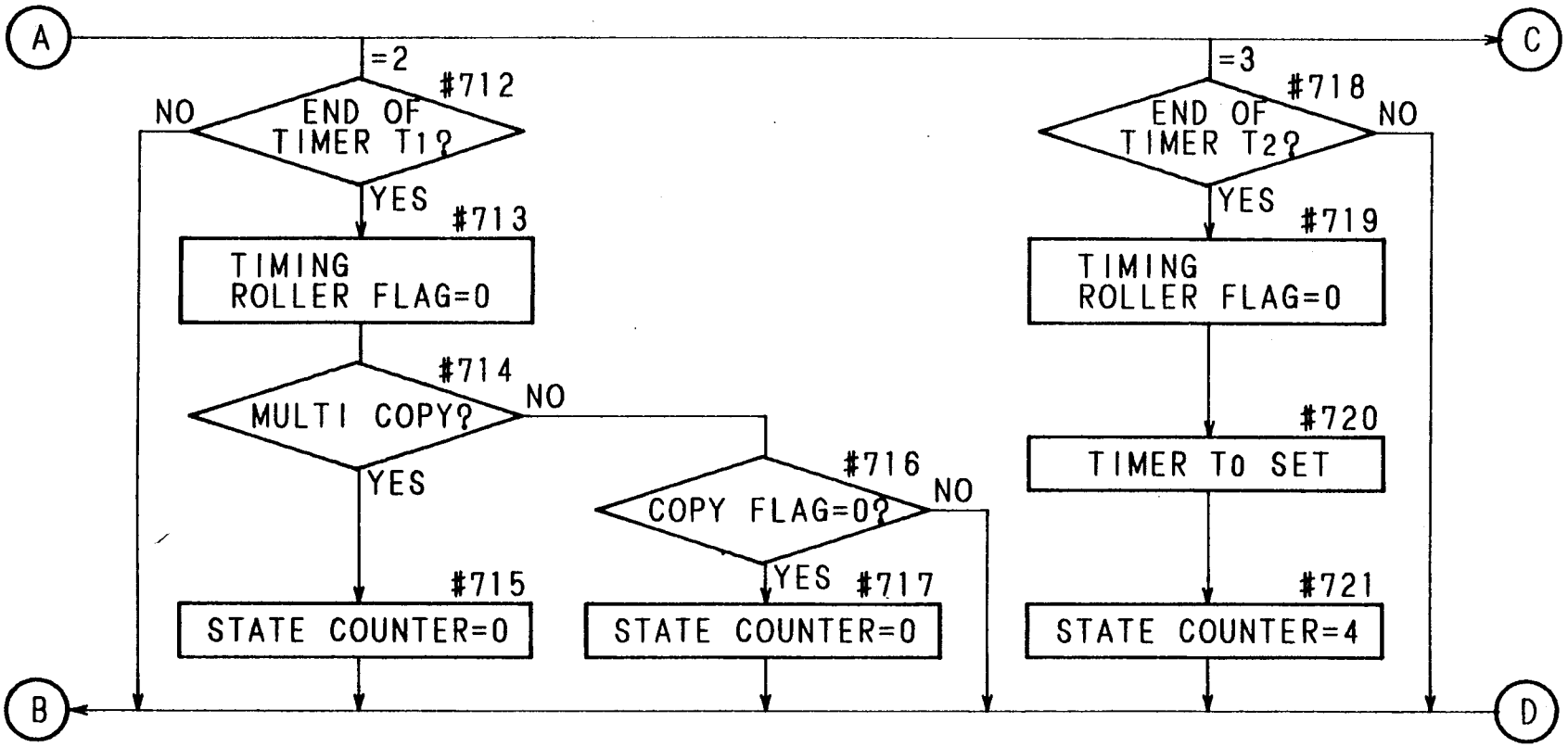
Figure 11C:
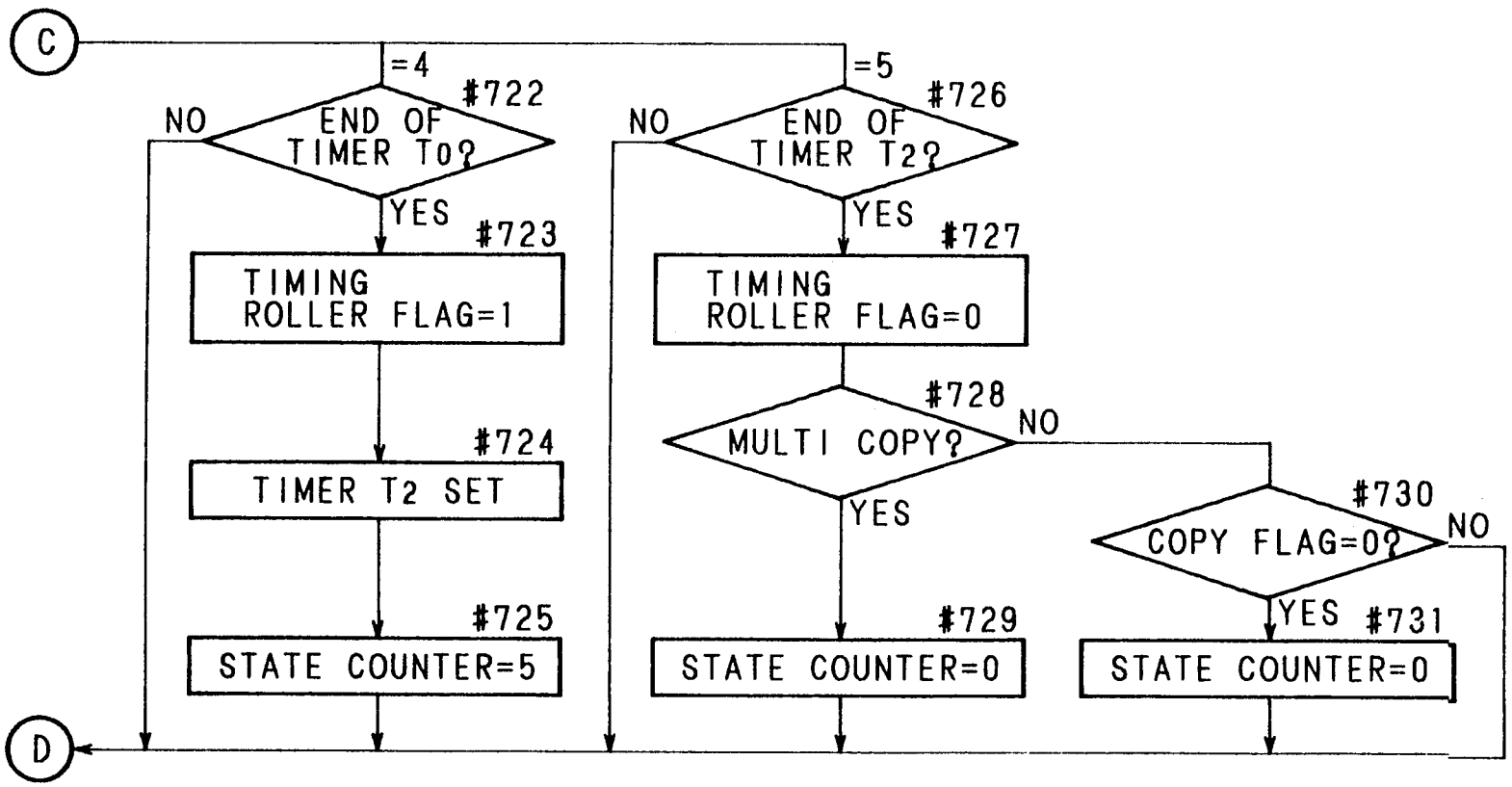

FIGS. 11(*a*) and 11(*b*) are flow charts showing the content of the transporting process in the step #111. In the first place, the value of the state counter (initial value 0) is checked (step #701). If the state counter is 0, the primary transfer flag is checked (step #702). If the primary transfer flag is 1, i.e., during the primary transfer, the timer t6 is set to determine the starting timing of the conveyance of the timing roller 46 (step #703), the state counter is set to 1 (step #704), and the other transporting processes are carried out (step #732). At this time, the flow is once returned to the main routine. At a next routine, the process when the state counter is 1 is conducted. When the state counter is 1, it is checked whether the timer t6 is completed (step #705). When the timer t6 is complete, the timing roller flag is set to 1 and the timing roller clutch 46*a* is turned ON, thereby to start the transportation of the copy paper P by the timing roller 46 (step #706). Thereafter, it is detected through the inputting state of the document selection button 232 and copy mode selection button 233 whether the book dividing copy mode is selected (step #707). Unless the book dividing copy mode is selected, the timer T1 is set so as to forward the paper P of the length equal to the image length for the secondary transfer in the whole area of the image section (step #708). The state counter is set to 2 (step #709), and the flow returns to the main routine. The procedure when the state counter is equal to 2 is proceeded at a next routine. On the contrary, if the book dividing copy mode is selected, the timer T2 is set so as to send the paper P of half the length of the image for the secondary transfer in the half area of the image section (step #710). Thereafter, the state counter is set to 3 (step #711). The flow is returned to the main routine. At a next routine, the process when the state counter is 3 is started. When the state counter is 2, whether the timer T1 is completed is checked (step #712). In the case where the timer T1 is not finished, the main routine is resumed. If the timer T1 is finished, the timing roller flag is reset to 0 and the timing roller clutch 46*a* is turned OFF to stop the transportation of the paper P by the timing roller 46 (step #713). It is now detected whether the multi copy is selected through the ten key 202 (step #714) and when the multi copy is selected, the state counter is reset to the initial value 0 (step #715). The flow is returned to the main routine. The transporting process for next copying will be carried out at a next routine. In the case where the multi copy is not ordered, the copy flag is checked (step #716). When the copy flag is 0, namely, copying is finished, the state counter is reset to the initial value 0 (step #717), with the flow returning to the main routine. On the contrary, if the copy flag is not 0, the flow is returned to the main routine, skipping the step #717.

When the state counter is 3, completion of the timer T2 is checked (step #718). When the timer T2 is complete and it is judged that the transportation of the paper P for the secondary transfer of one page of the spread space of half the length of the total image is finished, the timing roller flag is reset to 0 (step #719). At the same time, the timer T0 is set to determine the starting timing of the transportation of the paper P for the secondary transfer of the other page of the spread space (step #720). The state counter is subsequently set to 4 (step #721) and the flow is returned to the main routine. The procedure when the state counter is 4 is processed at a next routine. When the state counter is 4, it is checked whether the timer T0 is finished (step #722). If the timer T0 is not finished, the flow is returned to the main routine, whereas, if the timer T0 is terminated, the timing roller flag is set to 1 to start the transportation of the paper P for the secondary transfer of the other page of the spread space (step #723). Then, after the timer T2 is set so as to convey the paper P for the secondary transfer of half length of the image (step #724), the state counter is set to 5 (step #725), with the flow returning to the main routine. The procedure when the state counter is 5 is started at a next routine. Specifically, when the state counter is 5, it is checked whether the timer T2 is finished (step #726). When it is detected that the timer T2 is finished and the paper P for the secondary transfer of the other page is completed, the timing roller flag is reset on 0 (step #727) to complete the conveyance of the paper P. It is detected then whether the multi copy is ordered (step #728). In the case where the multi copy is selected, the state counter is reset to the initial value 0 (step #729) and the flow is returned to the main routine. The transporting process for next copying is carried out at a next routine. If the multi copy is not selected, the copy flag is checked (step #730). When the copy flag is 0, namely, copying is finished, the state counter is reset to the initial 0 (step #731). Accordingly, the flow is moved back to the main routine. When the copy flag is not 0, the flow is directly returned to the main routine.

Figure 12:
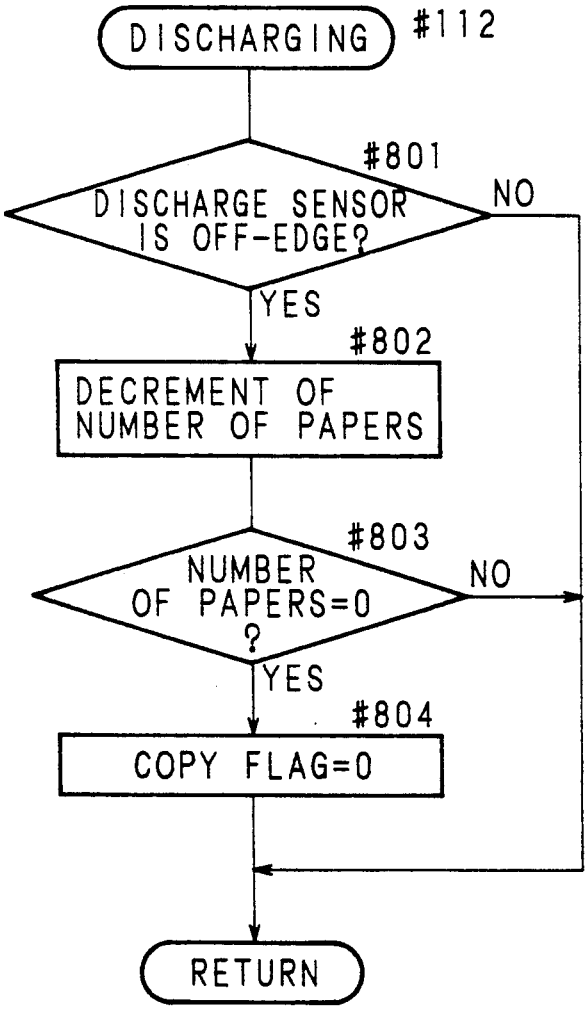
FIG. 12 is a flow chart showing the content of the discharging process of FIG. 4.

FIG. 12 is a flow chart showing the content of the discharging process in the step #112. It is first checked through the on/off edge of the discharge sensor 88 whether the rear end of the paper P passes near the discharge sensor 88 (step #801). When the discharge sensor 88 is off edge, the number of papers indicated by a counter (not shown) is decreased by one (step #802). The initial value of the counter is input through the ten key 202. When the ten key is not manipulated, the counter indicates 1. The remaining number of papers to be copied is checked by the value or number of the counter (step #803). When the counter shows 0, copying of the document is finished and therefore the copy flag is reset to 0 (step #804). If the discharge sensor 88 is not off edge in the step #801 or the counter does not indicate 0, that is, some papers remain yet to be copied in the step #803, the flow is returned to the main routine.

Figure 13:
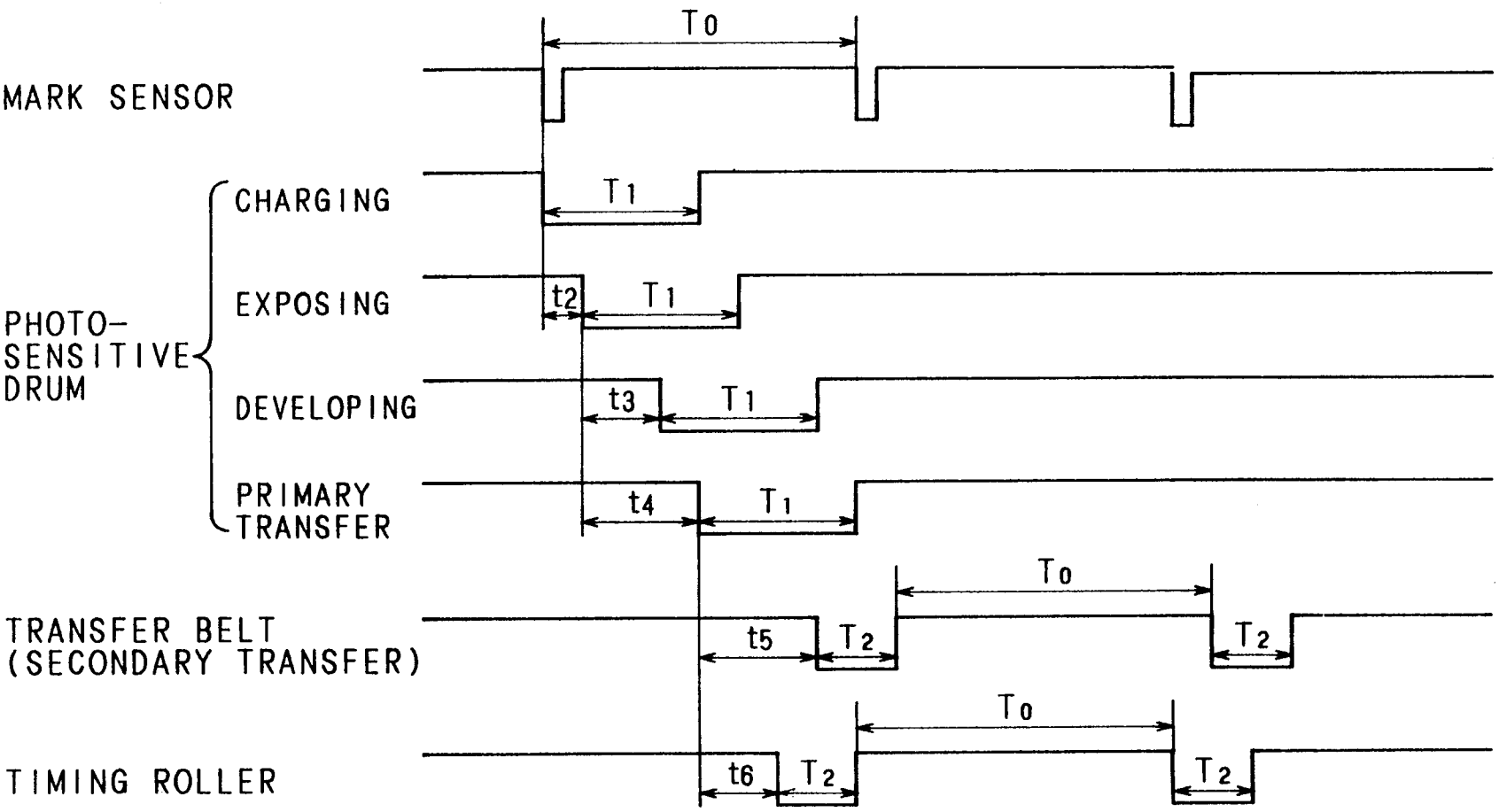
FIG. 13 is a timing chart of the dividing copy mode.
Figure 14:
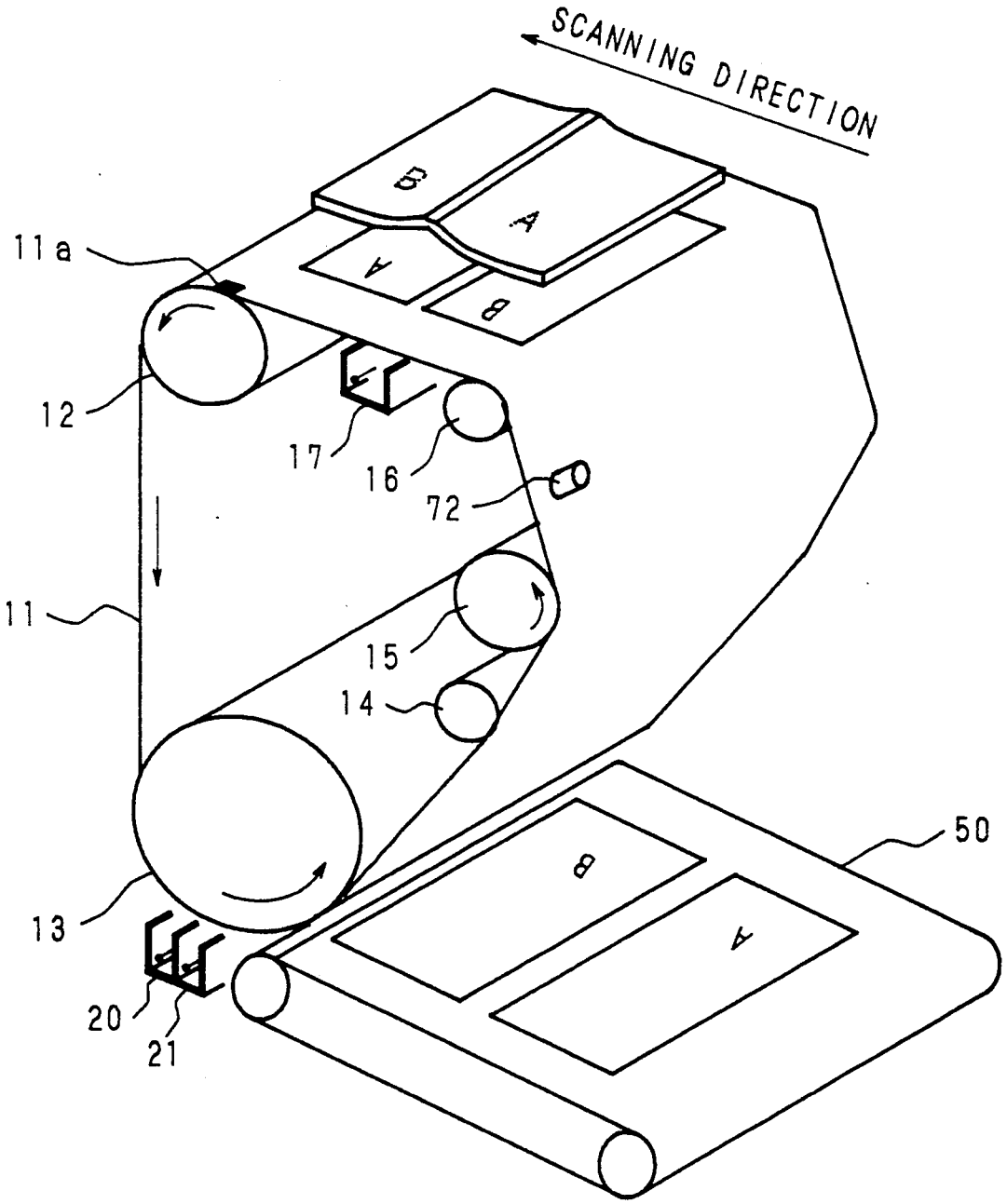
FIG. 14 is a perspective view of the state in the dividing copy mode.

Hereinafter, how each element is controlled to carry out the book dividing copy mode which is a characteristic feature of this invention will be depicted with reference to a timing chart of FIG. 13 and a perspective view of the copying machine of FIG. 14.

The book dividing copy mode is set by the document selection button 232 and copy mode selection button 233 as described earlier. When the print switch 200 is depressed in the book dividing copy mode, the belt mark 11*a* on the transfer belt 11 is detected by the mark sensor 72. A part of the photosensitive drum 3 corresponding to the image section is charged for T1 seconds. In consequence, the part of the photosensitive drum 3 is exposed by delaying the moving time of the photosensitive drum 3 by the timer t2 from the charging point to the exposing point. Similarly, developing by the selected developer 6–9 is performed by delaying t3 seconds and primary transfer by delaying t4 seconds is conducted by the transfer charger 17.

The image formed on the photosensitive drum 3 in the above process is primary-transferred onto the transfer belt 11. The image on the transfer belt 11 spreads over two pages in the book dividing copy mode. Therefore, the image is divided into two for the secondary-transfer of the image onto two papers P. After a delay of T0 seconds subsequent to the secondary transfer, for the time T2 which is half of the time T1 ($T2=T\frac{1}{2}$), another secondary transfer for the remaining time T2 is conducted. In this case, since the papers P are supplied by the timing roller 46 in synchronism with outputs of the transfer charger 20 the divided images are secondary-transferred to the two papers P and outputted as two sheets of copies.

Although the description of the embodiment is directed to the full-color copying machine using the transfer belt, this invention is not limited to this, but is applicable to a copying machine of general model without using the transfer belt. In such case, the cleaning device should be arranged to be selectively brought in pressed contact with and detached from the photosensitive drum, whereby the cleaning device is detached from the photosensitive drum after the transfer of one page of the spread space so as to prevent the toners on the photosensitive drum from being removed, and be brought in contact with the photosensitive drum after the transfer of the other page. That is, the photosensitive drum is cleaned at one time after the transfer.

Moreover, although explanation was given on the case that one document is divided into two according to the foregoing embodiment, as in the book dividing copy mode, this invention is not restricted to such arrangement and it is needless to say that this invention is applicable to the case where one document is divided into two or more image sections.

The divided images are copied onto separate papers in the foregoing embodiment. However, it is possible to copy the divided images onto the same paper. More specifically, the paper discharged after fixing may be sent to the re-feed route R2 by the switch lever 59 and further to the timing roller 46, or the paper may be forwarded until the rear end thereof reaches the discharge roller 57 and then the discharge roller 57 is rotated in the reverse direction and switch lever 59 is moved to feed the paper to the re-feed route R2 up to the timing roller 46. At this time, if the transfer timing and paper feed timing are controlled for another secondary transfer, the divided images can be transferred to the same surface of the copied paper or the front and rear surfaces of the paper. The former is called a synthetic copy, and the latter is a double-face copy.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An image forming apparatus, comprising: an image holding member which has an image holding surface;

image forming means for forming an image on said image holding surface;

means for dividing the image on the image holding surface into a first image section and a second image section;

transfer means, provided at a transfer position, for transferring the image on said image holding surface to transfer objects, said transfer means being switchable between an operative state to perform a transfer operation and an inoperative state wherein a transfer operation is not performed;

transporting means for transporting a first transfer object and a second transfer object successively to said transfer position;

rotating means for rotating said image holding member adjacent the transfer position; and control means for operating said transporting means, rotating means and transfer means in synchronization with each other such that said image holding means makes two revolutions past the transfer position and that the first image section of the image on the image holding surface is transferred to the first transfer object during one of the two revolutions of said image holding member and the second image section of the image on the image holding surface is transferred to the second transfer object during another one of the two revolutions of said image holding member.

2. An image forming apparatus as set forth in claim 1, wherein said first image section is substantially equal in size to said second image section.

3. An image forming apparatus as set forth in claim 2, wherein said first transfer object and said second transfer object are substantially equal in size to said first image section and said second image section, respectively.

4. An image forming apparatus as set forth in claim 1, wherein said first transfer object is one side of a copy sheet and said second transfer object is another side of the same copy sheet;

said transporting means includes a conveyer route to convey a copy sheet having an image once transferred thereon to said transfer position again.

5. An image forming apparatus as set forth in claim 4, wherein said transporting means has reversing means for reversing the copy sheet having an image thereon before conveying the copy sheet to said transfer position again.

6. An image forming apparatus as set forth in claim 1, wherein said control means switches said transfer means to the operative state when said first image section and said first transfer object reach said transfer position and switches said transfer means to the operative state when said second image section and said second transfer object reach said transfer position.

7. An image forming apparatus as set forth in claim 6, wherein said control means switches said transfer means to the inoperative state after said first image section and said first transfer object have passed said transfer position.

8. An image forming apparatus as set forth in claim 1, further comprising:

cleaning means for cleaning said image holding surface, said cleaning means being switchable between an operative state to perform a cleaning operation and an inoperative state wherein a cleaning operation is not performed; and cleaning control means for keeping said cleaning means in the inoperative state until the image of said first image section and the image of said second image section have both been transferred to the first transfer object and the second transfer object, respectively.

9. An image forming apparatus comprising:

an image holding member which has an image holding surface;

means for sequentially scanning first and second original documents during a single scanning operation;

means, in cooperation with said scanning means, for successively forming a first image and a second image, each corresponding to said first original document and said second original document, on the image holding surface of said image holding member;

rotating means for rotating said image holding member around a transfer position; and transfer means for transferring said first image to a first copy sheet during a first revolution of said image holding member and transferring said second image to a second copy sheet during a second revolution of said image holding member.

10. An image forming apparatus as set forth in claim 9, wherein said first original document is substantially equal in size to said second original document.

11. An image forming apparatus as set forth in claim 10, wherein said first copy sheet is substantially equal in size to said second copy sheet.

12. An image forming apparatus as set forth in claim 9, further comprising:

cleaning means for cleaning said image holding member, said cleaning means being switchable between an operative state to perform a cleaning operation and an inoperative state wherein a cleaning operation is not performed; and cleaning control means for keeping said cleaning means in the inoperative state until both said first image and said second image have been transferred to the first copy sheet and the second copy sheet, respectively.

13. An image forming apparatus, comprising:

a platen which supports an original document;

a photosensitive member;

image forming means for forming an image of said original document on said photosensitive member;

an intermediate transfer member;

first transfer means for transferring the image of said original document from said photosensitive member to said intermediate transfer member at a first transfer position;

second transfer means for transferring the image of said original document from said intermediate transfer member to a copy sheet at a second transfer position;

feeding means for feeding a first copy sheet and a second copy sheet sequentially to said second transfer position; and transfer control means for controlling said second transfer means so that one part of the image of said original document on the intermediate transfer member is transferred onto the first copy sheet and another part of the image of said original document on the intermediate transfer member is transferred onto the second copy sheet.

14. An image forming apparatus set forth in claim 13, wherein the image forming means includes a scanning means for forming an electrostatic latent image on said photosensitive member.

15. An image forming apparatus as claimed in claim 14, wherein the image forming means further includes a developing means for developing the electrostatic latent image into a toner image.

16. An image forming apparatus as claimed in claim 15, wherein the scanning means scans the original document on the platen and exposes image light to a surface of said photosensitive member in order to form said electrostatic latent image thereon.

17. An image forming apparatus as claimed in claim 13, wherein said scanning means includes means for forming said image with a single scanning operation.

18. An image forming apparatus as set forth in claim 13, further comprising:

cleaning means for cleaning said intermediate transfer member, said cleaning means being switchable between an operative state to perform a cleaning operation and an inoperative state wherein a cleaning operation is not performed; and cleaning control means for keeping said cleaning means in the inoperative state until said image and has been transferred to the first copy sheet and the second copy sheet.

19. An image forming apparatus comprising:

a photosensitive member;

means for sequentially scanning a first original document and a second original document during a single scanning operation;

means, in cooperation with said scanning means, for forming a first image and a second image, corresponding to said first original document and said second original document, respectively, on the photosensitive member;

an intermediate transfer member;

first transfer means for transferring said first image and said second image from the photosensitive member to the intermediate transfer member; and second transfer means for transferring said first image from the intermediate transfer member to a first copy sheet in a first transfer operation and for transferring said second image from the intermediate transfer member to a second copy sheet by a second transfer operation.

20. An image forming apparatus as set forth in claim 19, wherein said first original document is substantially equal in size to said second original document.

21. An image forming apparatus as set forth in claim 20, wherein said first copy sheet is substantially equal in size to said second copy sheet.

22. An image forming apparatus as set forth in claim 19, further comprising:

cleaning means for cleaning said intermediate transfer member, said cleaning means being switchable between an operative state to perform a cleaning operation and an inoperative state wherein a cleaning operation is not performed; and cleaning control means for keeping said cleaning means in the inoperative state until both said first image and said second image have been transferred to the first copy sheet and said second copy sheet, respectively.

* * * * *